US005974717A

United States Patent [19]

Brooks

[11] Patent Number: 5,974,717

[45] Date of Patent: Nov. 2, 1999

[54] FIREARM SAFETY MECHANISM

[75] Inventor: Frank Brooks, Jupiter, Fla.

[73] Assignee: SAF T Lok Corporation, West Palm Beach, Fla.

[21] Appl. No.: 09/237,218

[22] Filed: Jan. 25, 1999

Related U.S. Application Data

[60] Division of application No. 09/118,587, Jul. 17, 1998, which is a continuation-in-part of application No. 08/719,473, Sep. 25, 1996, Pat. No. 5,782,029.

[51] Int. Cl.[6] ..... F41A 17/00

[52] U.S. Cl. ..... 42/70.11; 42/70.02

[58] Field of Search ..... 42/70.11, 70.02; 70/DIG. 9

[56] References Cited

U.S. PATENT DOCUMENTS

| | | |
|---|---|---|
| H278 | 6/1987 | Steiner . |
| 804,694 | 11/1905 | Whiting . |
| 849,825 | 4/1907 | Allen . |
| 1,070,582 | 8/1913 | Browning . |
| 1,416,671 | 5/1922 | Artamendi . |
| 1,480,759 | 1/1924 | Hill . |
| 1,484,671 | 2/1924 | Pomeroy . |
| 2,436,267 | 2/1948 | Rogers . |
| 2,691,232 | 10/1954 | Hoopes . |
| 2,803,910 | 8/1957 | Lyle . |
| 2,846,925 | 8/1958 | Norman . |
| 2,945,316 | 7/1960 | Mulno . |
| 2,994,981 | 8/1961 | Carrigan . |
| 3,018,576 | 1/1962 | Riechers . |
| 3,027,674 | 4/1962 | Mahan . |
| 3,115,765 | 12/1963 | Fengler . |
| 3,159,080 | 12/1964 | Freed . |
| 3,199,240 | 8/1965 | Largen . |
| 3,368,297 | 2/1968 | Lentz . |
| 3,415,000 | 12/1968 | Koucky . |
| 3,462,869 | 8/1969 | Wallace . |
| 3,553,877 | 1/1971 | Welch . |
| 3,634,963 | 1/1972 | Hermann . |
| 3,673,725 | 7/1972 | Cravener . |
| 3,715,826 | 2/1973 | Seifried . |
| 3,722,238 | 3/1973 | Ring . |
| 3,724,113 | 4/1973 | Ludwig . |
| 3,729,014 | 4/1973 | Goodrich . |
| 3,735,519 | 5/1973 | Fox . |
| 3,757,634 | 9/1973 | Uria et al. . |
| 3,768,189 | 10/1973 | Goodrich . |
| 3,879,887 | 4/1975 | Cizeron . |
| 3,939,679 | 2/1976 | Barker et al. . |
| 3,962,809 | 6/1976 | Lee . |
| 3,978,603 | 9/1976 | Murabito . |
| 4,003,152 | 1/1977 | Barker et al. . |
| 4,014,123 | 3/1977 | Williams . |
| 4,031,648 | 6/1977 | Thomas . |
| 4,084,341 | 4/1978 | Cervantes . |
| 4,091,556 | 5/1978 | Katsenes . |
| 4,091,557 | 5/1978 | Murabito . |

(List continued on next page.)

OTHER PUBLICATIONS

Shooting Times, Apr. 1973, "Is Your Safety Really Safe?" pp. 40–43 and 78.

Beretta dal 1526, Series 81, Instructions for operation, Sep. 1986.

Smith & Wesson, Revolvers, Safety and Instruction Manual, Apr. 1987.

Smith & Wesson, Semiautomatic Centerfire Pistols, Safety, Instructions and Parts Manual, Jun. 1988.

*Primary Examiner*—Charles T. Jordan
*Assistant Examiner*—Meena Chelliah
*Attorney, Agent, or Firm*—Quarles & Brady LLP

[57] ABSTRACT

A firearm safety mechanism having a self-contained locking mechanism incorporated into the magazine of a semi-automatic pistol which inhibits use of the firearm when a locking mechanism disarms the firing mechanism as well as locking the magazine in position so as to prevent unauthorized replacement. The firearm can be locked against unauthorized use and unlocked by an authorized user without resort to external accessories.

9 Claims, 19 Drawing Sheets

U.S. PATENT DOCUMENTS

| | | | |
|---|---|---|---|
| 4,142,388 | 3/1979 | Phillips . | |
| 4,291,481 | 9/1981 | Hillberg . | |
| 4,302,898 | 12/1981 | LaRue . | |
| 4,306,487 | 12/1981 | Beretta . | |
| 4,384,420 | 5/1983 | Von Muller . | |
| 4,457,091 | 7/1984 | Wallerstein . | |
| 4,461,108 | 7/1984 | Von Muller . | |
| 4,479,320 | 10/1984 | Fix . | |
| 4,488,370 | 12/1984 | Lemelson . | |
| 4,499,681 | 2/1985 | Bako et al. . | |
| 4,532,729 | 8/1985 | Von Muller . | |
| 4,641,449 | 2/1987 | Kapland . | |
| 4,682,435 | 7/1987 | Heltzel . | |
| 4,763,431 | 8/1988 | Allan et al. . | |
| 4,768,302 | 9/1988 | Beretta . | |
| 4,769,936 | 9/1988 | Miller . | |
| 4,787,224 | 11/1988 | Mesa . | |
| 4,791,747 | 12/1988 | Pastor . | |
| 4,802,298 | 2/1989 | Baugus . | |
| 4,827,649 | 5/1989 | Sheehan . | |
| 4,845,870 | 7/1989 | Vernon . | |
| 4,854,065 | 8/1989 | French . | |
| 4,987,693 | 1/1991 | Brooks . | |
| 5,081,779 | 1/1992 | Pack . | |
| 5,088,222 | 2/1992 | Larson . | |
| 5,090,148 | 2/1992 | Brooks . | |
| 5,140,766 | 8/1992 | Brooks | 42/70.11 |
| 5,229,532 | 7/1993 | Brooks . | |
| 5,291,763 | 3/1994 | Cuisinot . | |
| 5,335,521 | 8/1994 | Brooks | 70/298 |
| 5,408,777 | 4/1995 | Brooks . | |
| 5,457,907 | 10/1995 | Brooks . | |
| 5,467,550 | 11/1995 | Mumbleau . | |
| 5,732,497 | 3/1998 | Brooks | 42/70.11 |
| 5,749,166 | 5/1998 | Brooks | 42/70.11 |

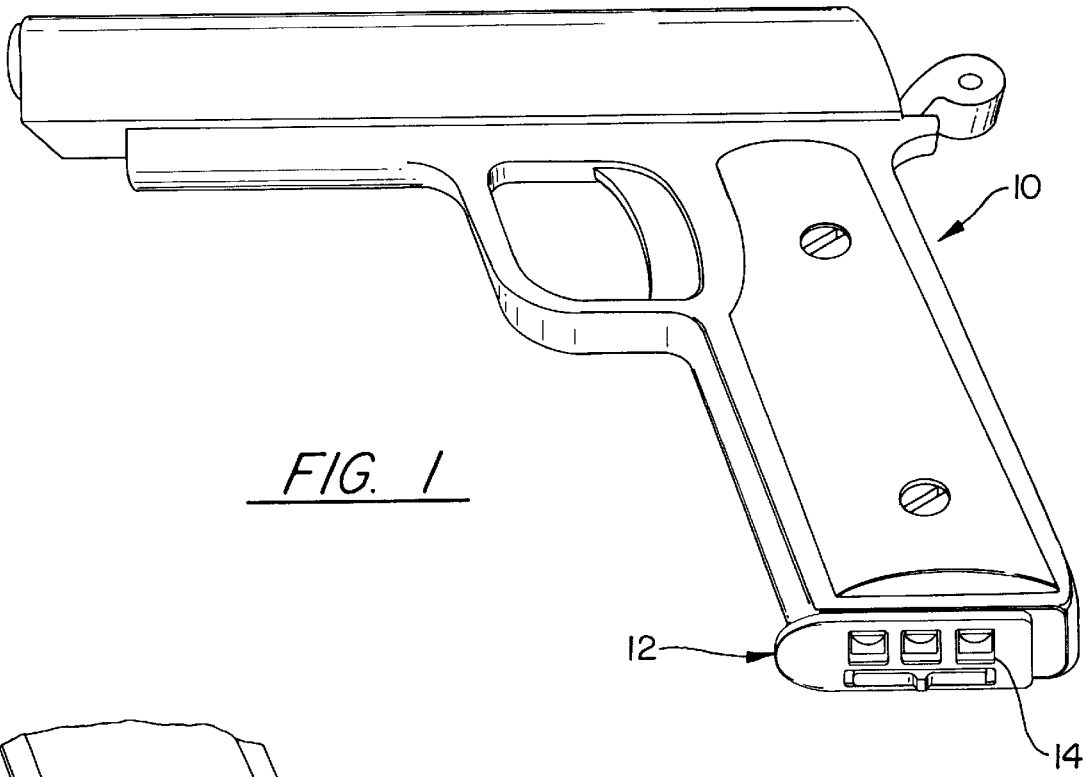
FIG. 1
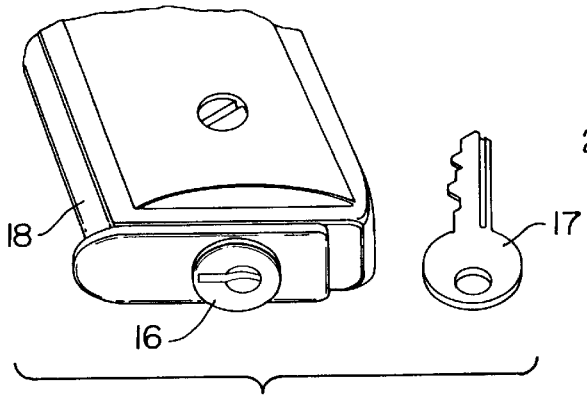
FIG. 2
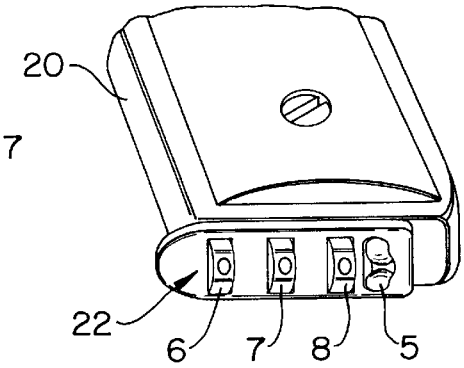
FIG. 3
FIG. 4
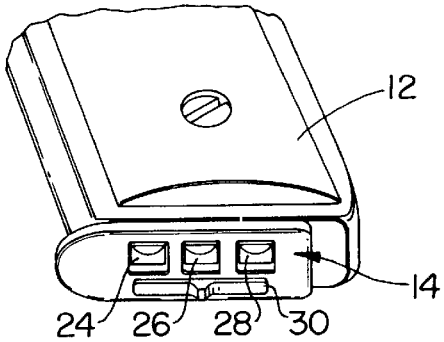

FIREARM SAFETY MECHANISM

CROSS REFERENCE TO RELATED APPLICATIONS

This application is a division of U.S. patent application Ser. No. 09/118,587 filed Jul. 17, 1998, which is a continuation-in-part of U.S. patent application Ser. No. 08/719,473 filed Sep. 25, 1996, now U.S. Pat. No. 5,782,029.

FIELD OF THE INVENTION

A firearm safety mechanism for semi-automatic and automatic pistols and rifles equipped with a magazine or clip and revolvers equipped with a rotating cylinder.

DESCRIPTION OF THE PRIOR ART

There is a continuing concern about the prevalence of firearms in our society. Whether the firearm is a BB-gun, handgun, rifle, or military weapon, one of the objections to firearms relates to the use of these weapons by unauthorized persons. Tragic accidents occur when children happen upon firearms found often in their own homes, and attempt to play with them.

The safety mechanisms found on firearms are not adequate to prevent injury, as curious children will often move the safety to an "off" position without their knowledge. A measure of safety can be obtained by removing the bullets from the firearm but it is time consuming to load a weapon in an emergency situation, and the danger exists that the gun will not be loaded fast enough to confront the emergency situation.

Another alarming situation is encountered when unauthorized persons wrestle such firearms from the hands of a gun wielder such as a police officer. In such an incident, the safety is only a slight impediment to firing of the firearm. At best, an engaged safety might give the police officer only an instant to try and retrieve the weapon. This situation might present itself to any individual who owns a handgun wherein the unauthorized person, such as the criminal element, is able to overpower the firearm owner and then use the firearm against the owner.

The applicant has previously disclosed locks adapted to be integrally included with firearms and which are able to prevent unauthorized use of the firearm. These locks contain portions which are adaptable to operatively engage a portion of the firing mechanism of the firearm to prevent operation of the firearm. This portion of the lock is moved out of operative engagement with the firing mechanism when the lock is in the "unlocked" position, to permit operation of the firearm.

The inventor has been awarded U.S. Pat. No. 4,987,693 for a firearm safety mechanism; U.S. Pat. No. 5,090,148 for a firearm safety mechanism; U.S. Pat. No. 5,140,766 for a draw bar firearm lock; U.S. Pat. No. 5,229,532 for a grip lock assembly; and U.S. Pat. No. 5,335,521 for a grip lock assembly. Each of these disclosures sets forth embodiments of individual locking mechanisms which are incorporated herein by reference. The Applicant has previously disclosed constructions in which a locking bar moves into and out of an operative engagement with an existing external safety mechanism of the weapon to alternatively prevent or permit movement of the existing safety to the "unsafe" position. In another disclosure, a pin is moved into and out of an obstructing position with respect to the path of the hammer of the firearm to prevent or permit operation of the firearm.

There exists a continuing need to provide alternative lock configurations for the many firearms which are currently in existence. Particularly, there is a need to facilitate the installation of locks on existing firearm which include a magazine or clip of a semi-automatic pistol or rifle.

SUMMARY OF THE INVENTION

It is an object of the invention to provide a firearm safety mechanism which will render the firearm inoperable to unauthorized users. It is another object of the invention to provide a firearm safety mechanism which can be quickly activated or de-activated by an authorized user. It is still another object of the invention to provide a firearm safety mechanism which is easily installed.

These and other objects are accomplished by a firearm safety mechanism in which a lock is installed in the magazine or clip of a semi-automatic or automatic pistol or rifle.

In one embodiment, a portion of the safety lock in the magazine or clip of a semi-automatic pistol can be moved into position to block the firing mechanism or existing safety on the firearm. Alternatively, a portion of the lock can be positioned wherein the bullets in the magazine cannot be loaded into the firing chamber, and/or the magazine cannot be released from its handle position. In this manner, a lock is located on the magazine, thereby employing either a conventional key lock, a rotary combination lock, a touch-sensitive combination lock, or other suitable lock. An advantage to this location for the lock is the ability to modify a firearm by simple replacement of a conventional magazine, with the magazine having a locking mechanism fully integrated therein. The safety or firing mechanism can be locked into a non-operative position. Additionally, the magazine lock has a provision for securing the bullets in the magazine and/or securing the magazine to the firearm which would conveniently prevent access to the bullets. In this manner, the magazine could not be removed from the gun without an authorization key or combination code.

The firearm may be returned to its original state by replacement of the magazine having the locking mechanism with the unmodified magazine. The type of lock that is used can be selected from a number of suitable designs. A preferable lock design is a combination lock in which one or more push members, such as buttons, are provided. Each of the buttons must be depressed an appropriate number of times, corresponding to the combination of the lock, in order to unlock the lock and to permit operation of the firearm. The Applicant has disclosed in the Applicant's prior patents a variety of locks suitable for this purpose, although other locks would also be acceptable. It is also preferred that the lock be operable without the necessity of seeing the lock, allowing the lock to be disengaged in a dark environment. Thus, in the preferred embodiment, the lock comprises one or more push members, where each push member must be depressed a number of times, or in a proper sequence in order to open the lock.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a side view of semi-automatic pistol equipped with a magazine lock of the instant invention;

FIG. 2 is an end view of a magazine with a key lock;

FIG. 3 is an end view of a magazine with a rotary combination lock;

FIG. 4 is an end view of a magazine with a touch sensitive combination lock;

DETAILED DESCRIPTION OF THE PREFERRED EMBODIMENT

Figure 5:
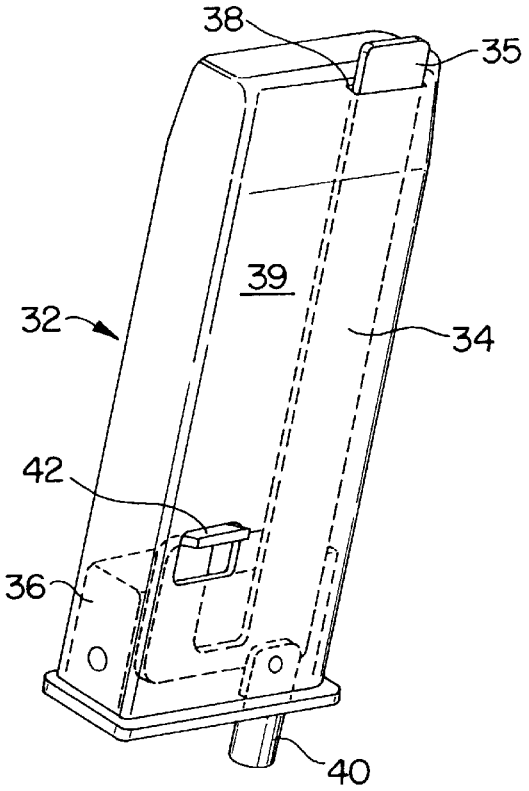
FIG. 5 is a pictorial view of a magazine with a locking device for preventing operation of a semi-automatic pistol firing mechanism.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

The safety mechanism of the invention can be used, with minor modification, in gun designs of many descriptions. The operation of most handguns is well understood, and described in several volumes including the Gun Digest Book of Firearms Assembly/Disassembly, Parts I and II; Automatic Pistols and Revolvers, by J. D. Wood, D.B.I. Books, Inc., Northbrook, Ill., 1979; The S&W Revolver, A Shop Manual, Jerry Kuhnhavsen, V.S.P. Publishers, Department 1A, Box 1966, Tusten, Calif. 92681; The Colt 45 Automatic, A Shop Manual, Jerry Kuhnhavsen, V.S.P. Publishers, Department 1A, Box 1966, Tusten, Calif. 92681; and the NA Guide to Firearms Assembly, National Rifle Association of America, 1600 Rhode Island Avenue N.W., Washington, D.C. 20036. The disclosures of the above-identified references are herein fully incorporated by reference. The invention can be utilized with automatic firearms such as the Baretta model 84BB, manufactured by the Fabbric d'ArmiPietro Beretta S.P.A. o Via Pietro Beretta, 18-25063 Gardone Val Trompia, Brescia, Italy. The weapon is fully described in the Owner's Manual Beretta dal 1526, Series 81, distributed by the company, which manual hereby is fully incorporated by reference. The invention can also be utilized with the Smith & Wesson semiautomatic centerfire pistols manufactured by the Smith & Wesson Company of 2100 Roosevelt Avenue, Springfield, Mass. The weapons are fully described in the Safety Instruction & Parts Manual, distributed by the company, which manual is hereby fully incorporated by reference.

Referring now to FIG. 1, a semi-automatic pistol 10 is shown with a magazine 12 which includes a push button locking mechanism 14 of the present invention. Referring also to FIG. 2, an alternative key lock mechanism 16 and key 17 are shown incorporated into the end of the magazine 18. FIG. 3 shows yet another alternative magazine 20 with a rotary locking mechanism 22 having a three rotary combination wheels 6, 7, and 8, and an activation lever 5. FIG. 4 shows the magazine 12 of FIG. 1 with the push button, or touch sensitive, locking mechanism 14. In this instance, the mechanism 14 includes three push buttons 24, 26, and 28, and a slide bar activation lever 30.

Figure 6:
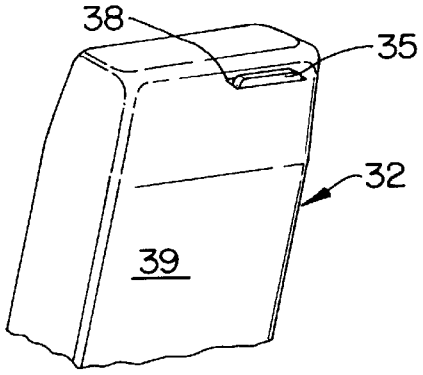
FIG. 6 is a top pictorial view of the magazine of FIG. 5.

Referring now to FIG. 5, a pictorial view of an embodiment of a magazine 32 is shown with a blocking arm or actuating member 34 which is controlled by the inner locking module 36. The module 36 contains the operable parts of the locking mechanism, e.g. the tumblers and associated hardware which are operable when the lock buttons, rotary wheels, or key are used. In this example, the blocking arm 34 extends up through the magazine 32 with the top portion 35 protruding out of a hole 38 in the top of the magazine casing 39. The arm 34 is operably connected to the locking module 36 so that it can be moved only when the locking mechanism is unlocked. A push-button or activation lever 40 extends from the bottom of magazine and allows advancement and retraction of the blocking arm 34 when the lock is unlocked. An interlocking bar 42 also extends from a cutout in the side of the magazine casing 39. This bar 42 serves to lock the magazine 32 in place so that it cannot be removed and thereby thwart the locking of the firearm. In FIG. 6, the top of the magazine casing 39 is shown with blocking arm portion 35 withdrawn or retracted into the magazine 32.

Figure 7:
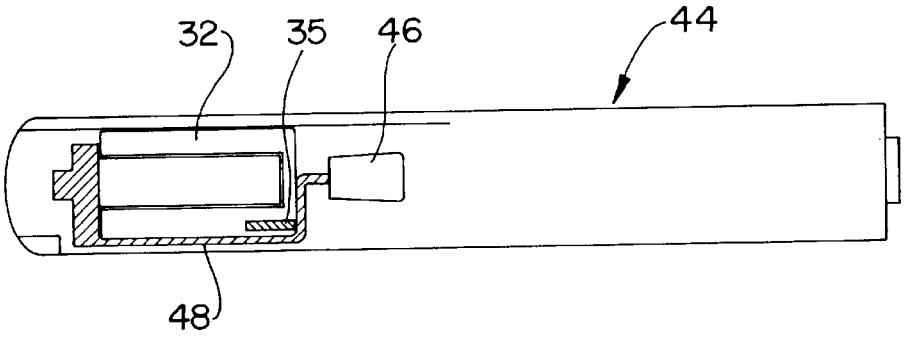
FIG. 7 is a top partial cut-away view of the pistol of FIG. 1 showing the trigger bar being blocked by the magazine locking device.

Referring now to FIG. 7, a top view of a firearm 44 is shown with a partial cut-away view of the trigger 46 and associated trigger bar 48 inside the gun. The magazine 32 is shown inserted into the gun 44 with the upper portion of the blocking arm or actuating member 35 positioned to impede movement of the trigger bar 48. In this position, the trigger 46 cannot be pulled to fire the gun. The blocking arm or actuating member, when extended, is therefore positioned to block movement of the trigger bar 48.

Figure 8:
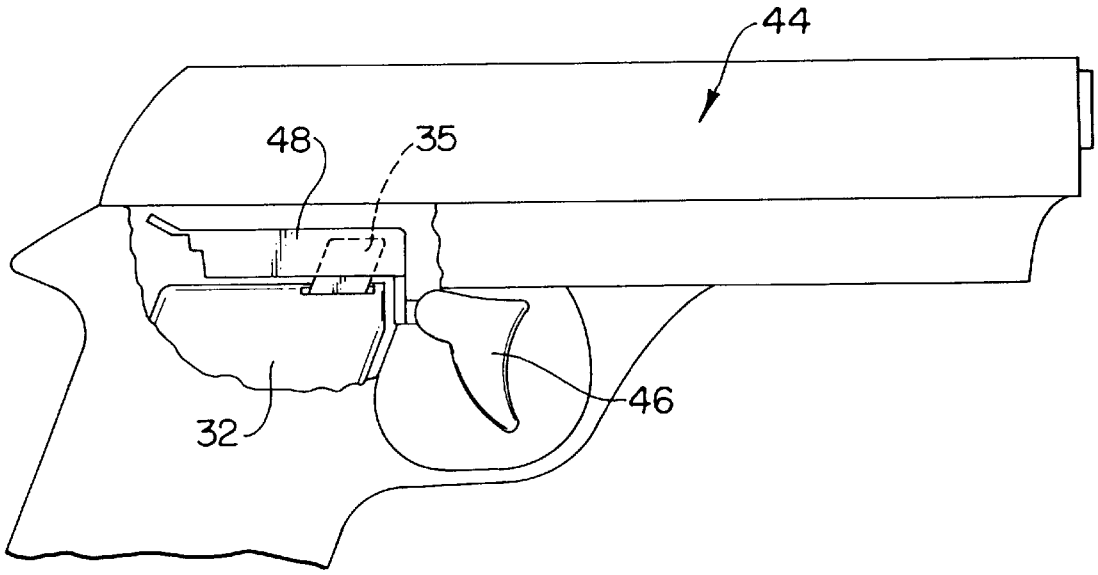
FIG. 8 is a side partial cut-away view of the pistol of FIG. 7 showing the trigger bar being blocked by the magazine locking device.
Figure 9:
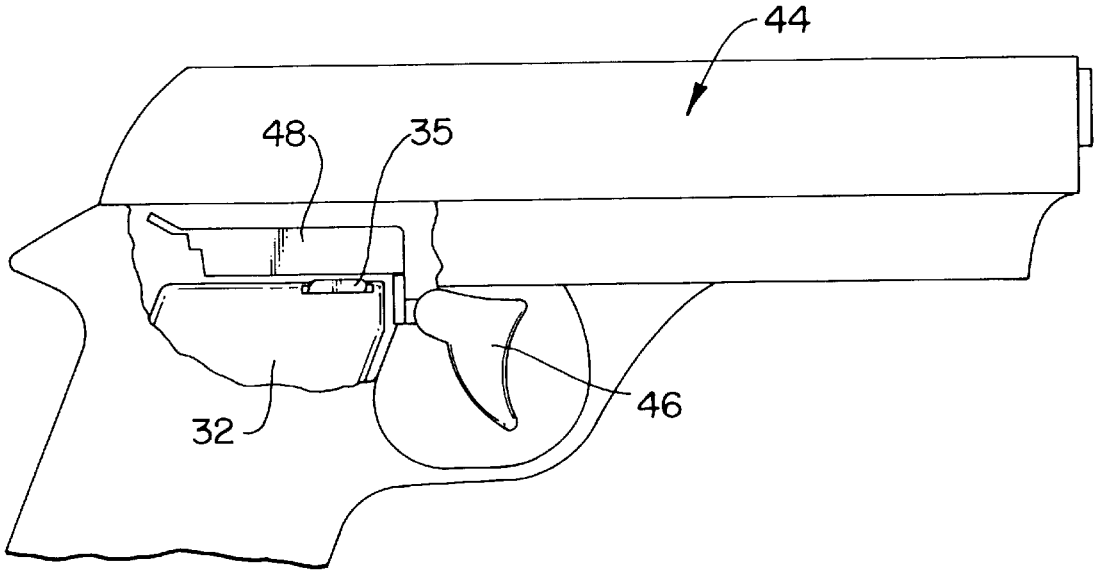
FIG. 9 is a side partial cut-away view of the pistol of FIG. 7 showing the trigger bar unblocked by the withdrawn magazine locking device.

Referring now to FIG. 8, a side view of the firearm 44 is shown with a cut-away section of the trigger 46 and trigger bar 48. The magazine 32 is shown inserted into position with the blocking arm or actuating member 35 extended upwards to block the trigger bar 48. Referring also to FIG. 9, a similar view is shown with the actuating member 35 retracted. The trigger bar 48 can therefore be moved backwards by the trigger 46 thereby firing the gun.

Figure 10:
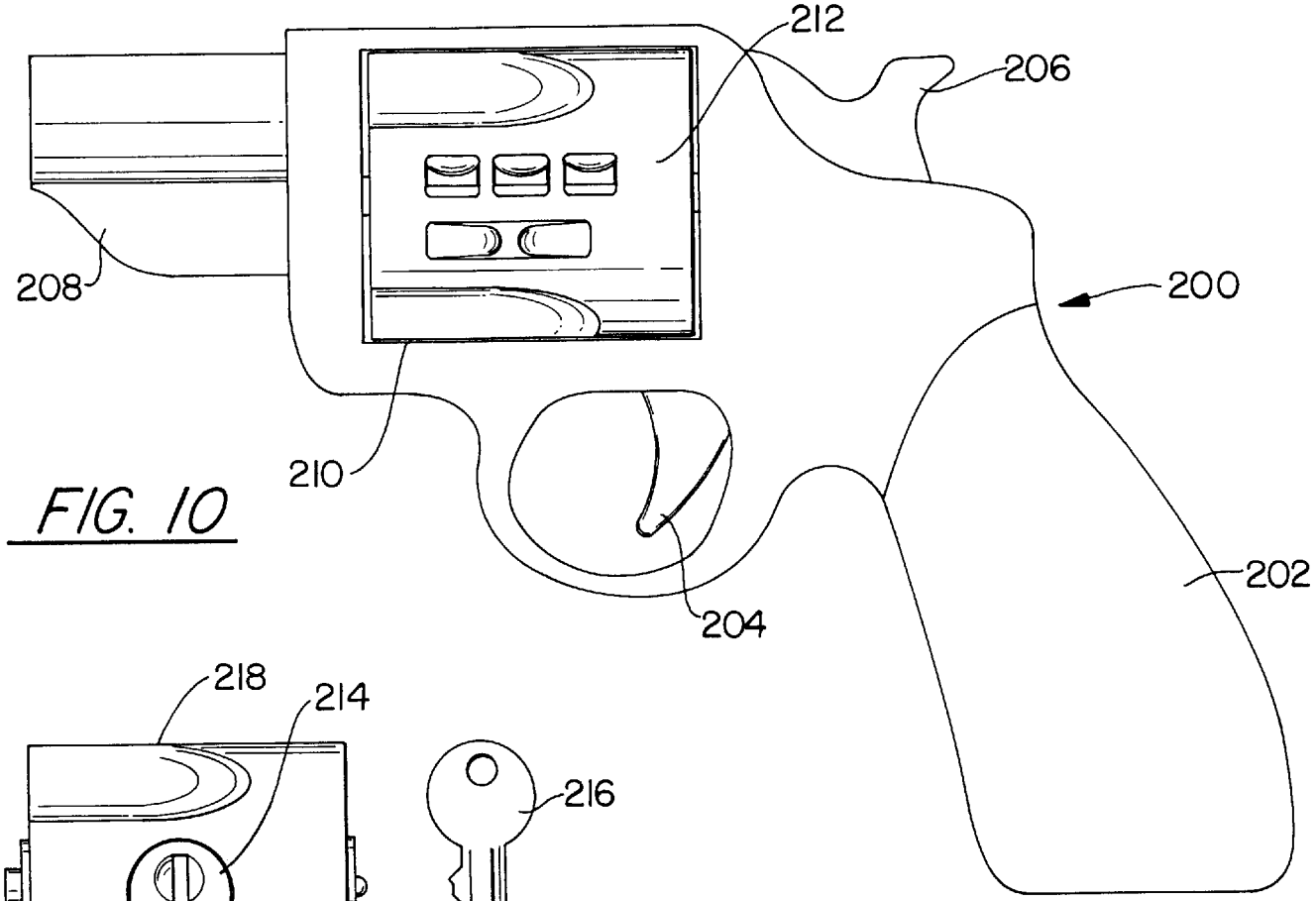
FIG. 10 is a side view of revolver equipped with a cylinder lock of the instant invention.
Figure 11:
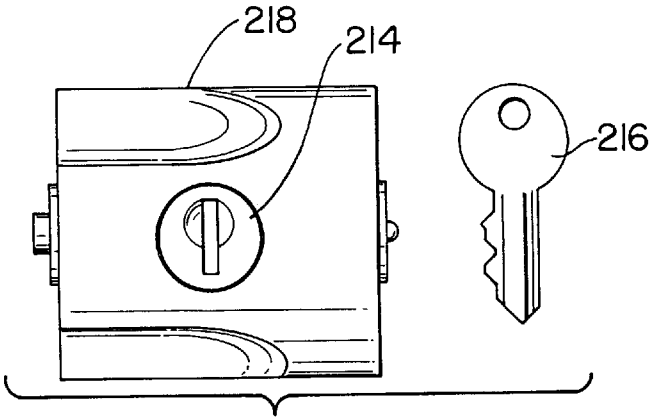
FIG. 11 is a side view of a cylinder with a key lock.
Figure 12:
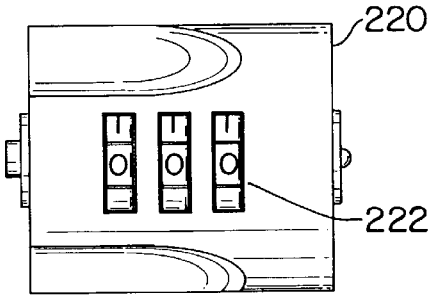
FIG. 12 is a side view of a cylinder with a rotary combination lock.
Figure 13:
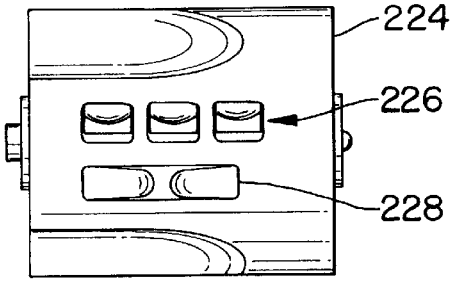
FIG. 13 is a side view of a cylinder with a touch sensitive combination lock.

Referring now to FIG. 10, a revolver 200 is depicted having a handle 202, trigger 204 and hammer mechanism 206, barrel 208 and cylinder 210. The cylinder is the only part of the revolver that will have a modification allowing the cylinder to be replaced with a locking mechanism 212 of the present invention. The modified cylinder 210 will contain ammunition. Referring also to FIG. 11, an alternative key lock mechanism is depicted having key lock 214 and key 216 shown incorporated into the side wall of cylinder 218. FIG. 12 shows yet another alternative cylinder 220 with a rotary locking mechanism 222 having three rotary combination wheels. FIG. 13 shows the preferred embodiment incorporating a similar locking mechanism as the Applicant has disclosed in prior art patents previously listed. Cylinder 224 has a touch sensitive locking mechanism with depression buttons 226 and engagement bar 228.

Figure 14:
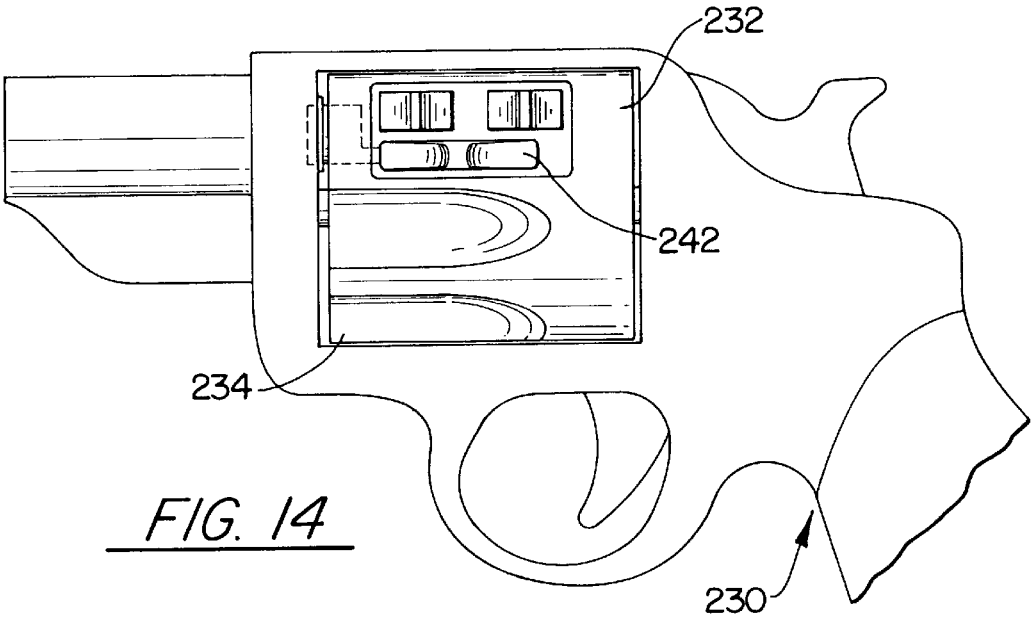
FIG. 14 is a side view of a revolver equipped with a cylinder lock in the locked position.
Figure 15:
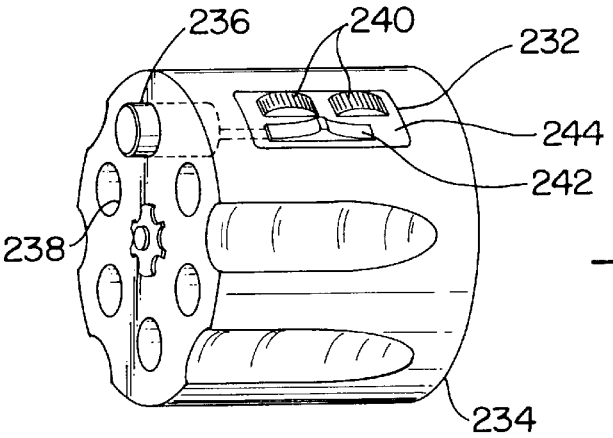
FIG. 15 is a pictorial view of the extracted cylinder of FIG. 14.

Referring now to FIGS. 14 and 15, a revolver 230 is depicted with a preferred locking mechanism 232 incorporated into detachable cylinder 234. A member 236 coupled to the locking mechanism 232 is depicted in an extended position, within one of the chambers 238 of cylinder 234, for partial insertion into the barrel of the revolver. The locking mechanism 232 having combination buttons 240, preferably two or three, as depicted in FIG. 13, provides an authorized user with a means for moving the member 236 into the depicted extended position inhibiting movement of the cylinder. Slide bar 242 is coupled to the member 236 allowing engagement or disengagement as needed. The buttons 240 and slide bar 242 have a low clearance positioned within depression 244 commonly found on such cylinders for use as a gripping surface.

Figure 16:
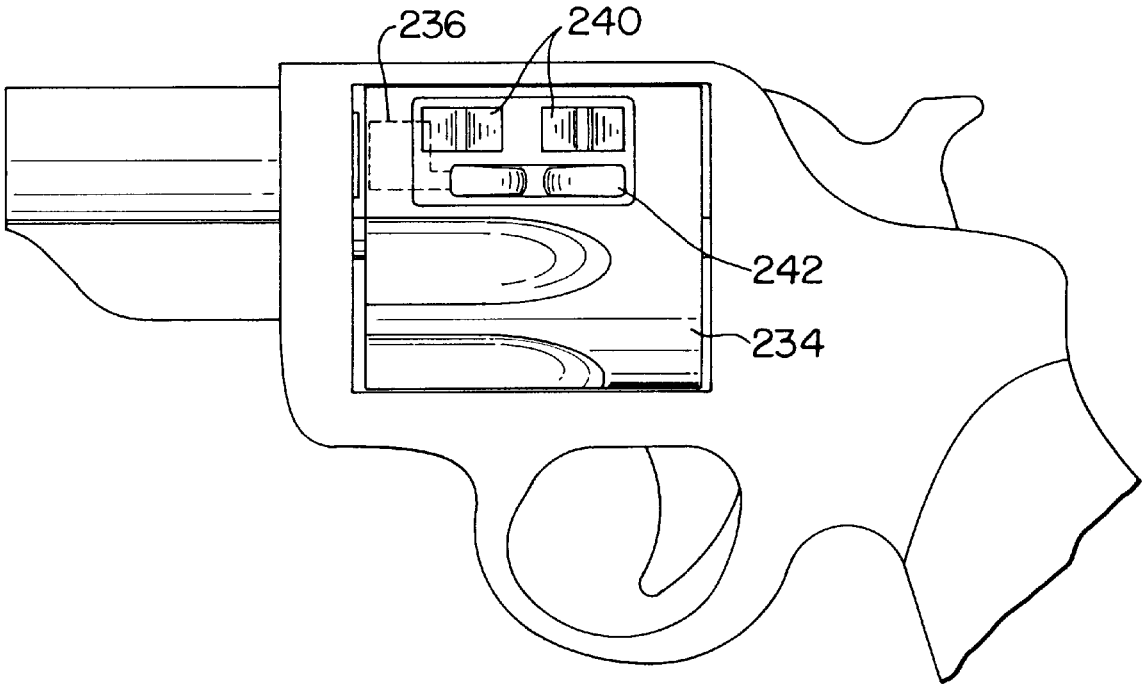
FIG. 16 is a side view of the revolver of FIG. 14 with the cylinder lock in the unlocked position.
Figure 17:
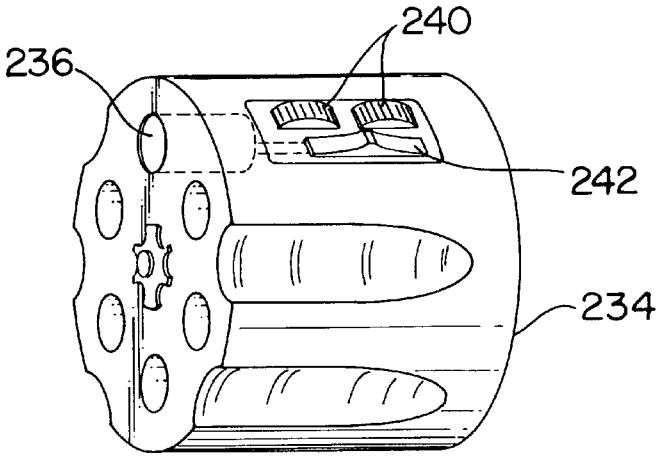
FIG. 17 is a side view of the extracted cylinder of FIG. 16.

As depicted in FIGS. 16 and 17, revolver 230 is depicted with a locking mechanism 232 incorporated into detachable cylinder 234 and member 236 positioned in a retracted position. In this manner, the locking mechanism is disengaged and an authorized user may utilize the firearm without restriction.

In an alternative embodiment, not shown, the locking mechanism can be placed external of the chamber with provision made to lock the cylinder in such a position so that the firing pin is not aligned with a chamber. In this embodiment a locking pin protrudes from the cylinder to engage either edge of the revolver body and an impact pad may be positioned between the chambers of the cylinder to prevent damage to the firing pin if the chamber is off center and the firing pin forced to impact the cylinder.

Figure 18:
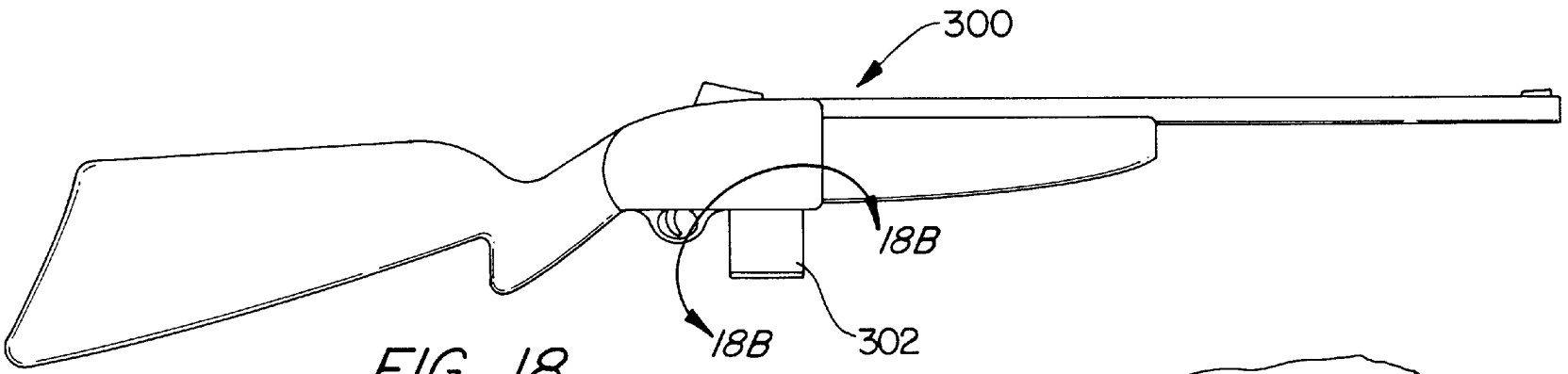
FIG. 18 is a side view of a rifle or longarm weapon with a locking magazine installed.
Figure 18B:
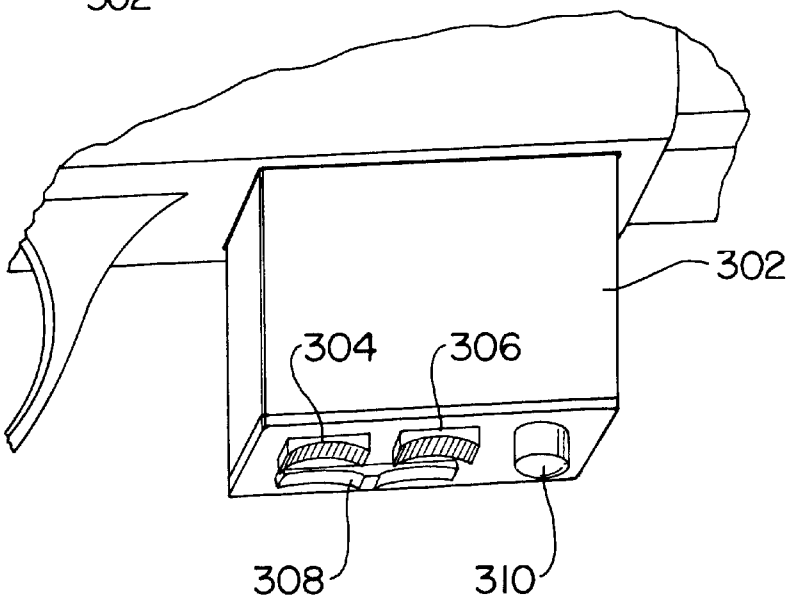
FIG. 18B is a close-up pictorial view of the mounted locking magazine of FIG. 18.
Figure 18A:
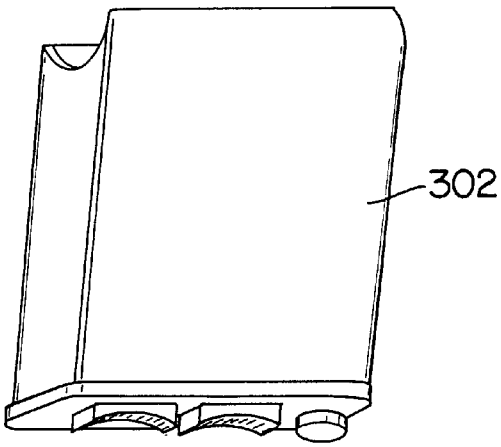
FIG. 18A is a side pictorial view of the extracted locking magazine of FIG. 18.
Figure 19:
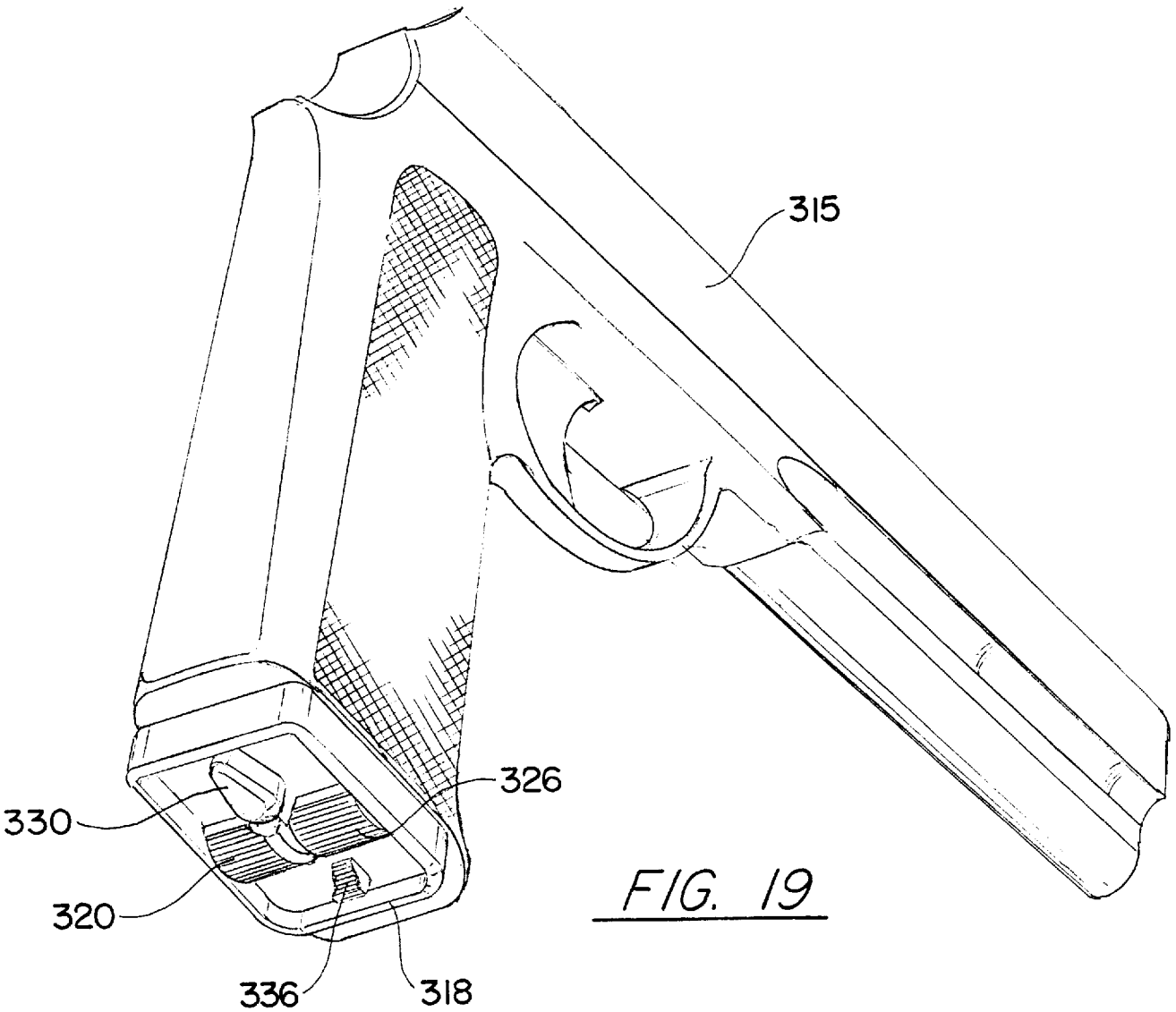
FIG. 19 is a perspective view of a firearm having a magazine with an alternative embodiment of the invention.
Figure 22:
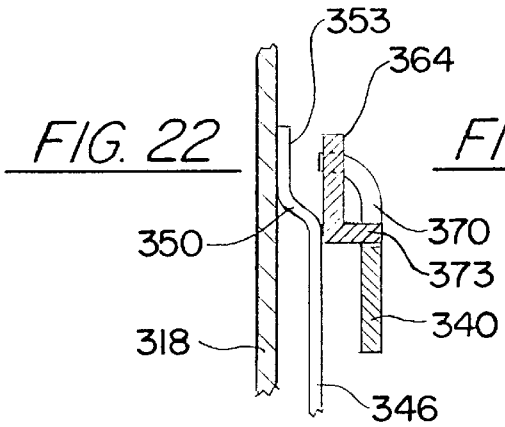
FIG. 22 is a side elevation, partially cut away, of a blocking member according to the invention, in a first mode of operation.

Referring now to FIG. 18, a long arm, including a shotgun or rifle 300 is shown with a locking magazine 302 of the present invention installed. Referring also to FIG. 18A, the magazine 302 is shown extracted from the long arm. FIG. 18B shows a close view of the magazine 302 installed in the long arm 300. In this embodiment, the magazine includes a first and second pushbutton 304, 306 with an activation lever 308 and a pushbutton activator 310.

A handgun 315 having an alternative embodiment of the invention is shown in FIGS. 19–23. The handgun includes a magazine 318 having a generally elongated housing with an open container in which to receive bullet ammunition 314. The magazine 318 has a lock 317 and, in the locked position, is operable to prevent operation of the firearm, and in the unlocked position, to permit operation of the firearm. Suitable structure such as left combination button 320 and right combination button 326 can be provided with which to enter the combination. A manual lever 330 can be provided with which to permit the gun to fire when the proper lock combination has been entered. A reset button 336 is provided which enables the user to reset the combination lock to an initial position, to enable the user to reenter the combination.

Figure 23:
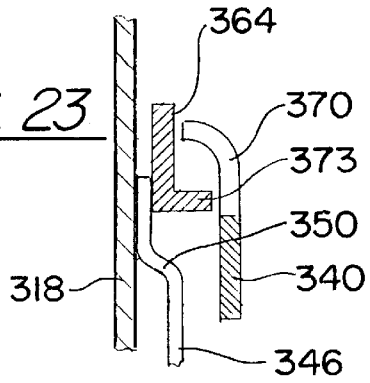
FIG. 23 is a side elevation, partially broken away, of the blocking member in a second mode of operation.
Figure 20:
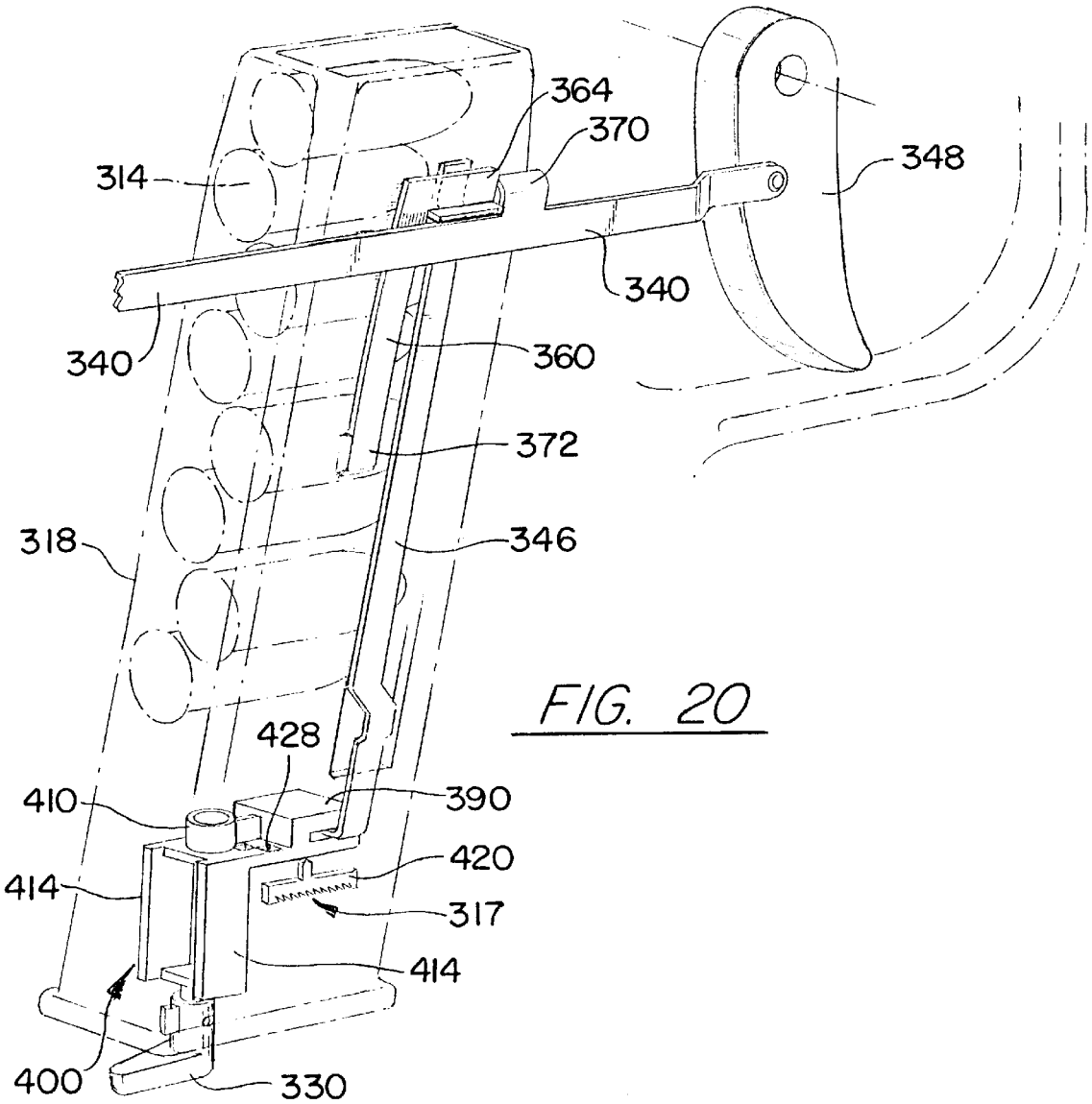
FIG. 20 is a perspective view, partially in phantom, of a gun magazine as installed in a firearm, and in a first mode of operation.
Figure 21:
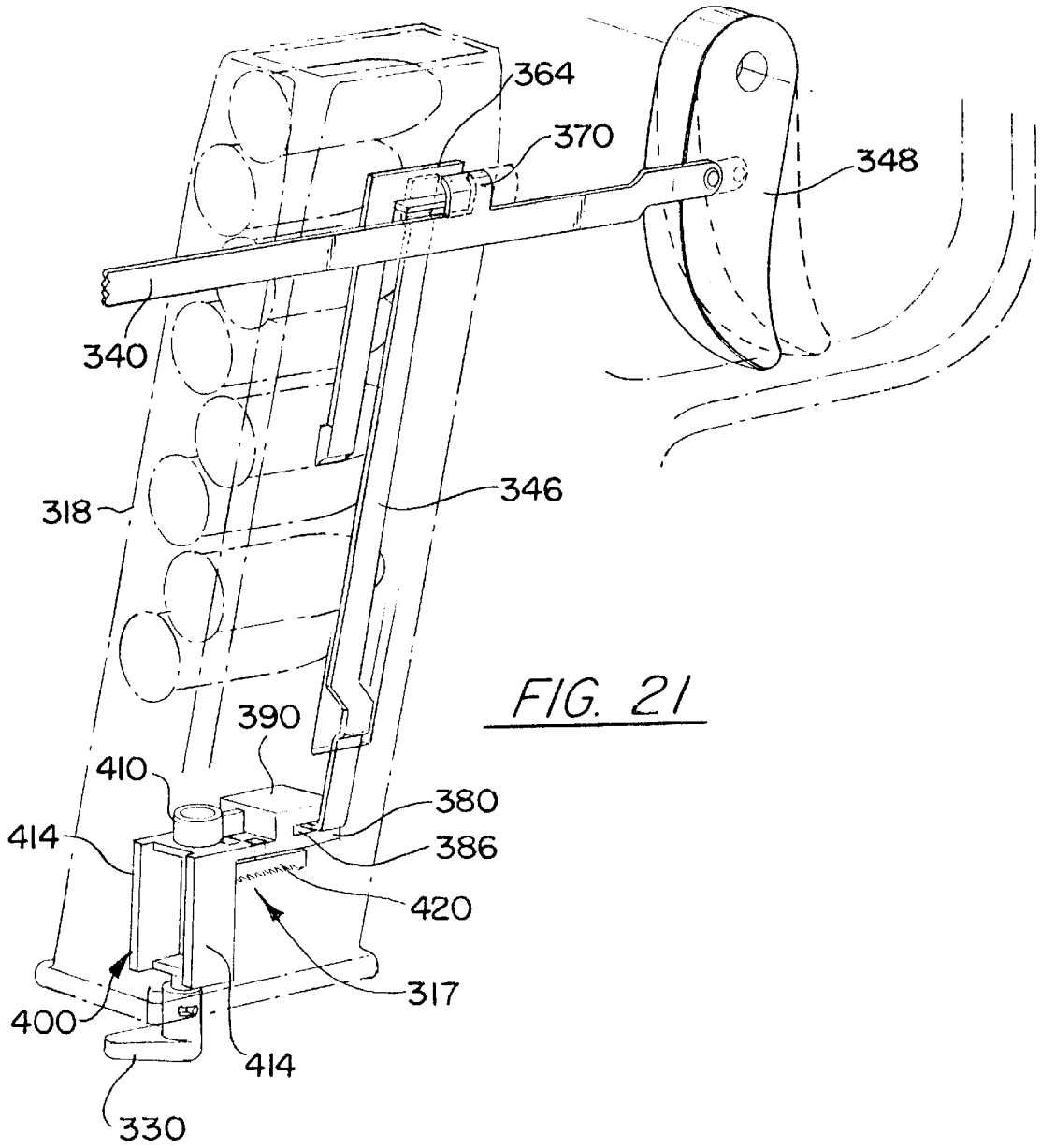
FIG. 21 is a perspective view, partially in phantom, of a magazine of FIG. 20, in a second mode of operation.

The manner by which a lock functions to prevent operation of the firearm is capable of variation, depending on the type of firearm that is utilized, the type of magazine that is required for the firearm, and other similar considerations. One way of interrupting operation of the firearm is shown in FIG. 20. A drawbar 340 is connected by the trigger 348 of the firearm to the hammer (not shown) so as to fire the weapon in a conventional manner. A lock relay arm 346 extends upward from the lock 317. The lock relay arm 346 has a shoulder 350 which terminates in a flat abutment portion 353 which contacts the side of the magazine 318. A blocking member 360 has an abutment portion 364 at one end, and is fixed to the magazine 318 at opposite end 372. Up and down movement of the lock relay arm 346 causes the shoulder 350 to contact the abutment portion 364 to move it outward in the upward position (FIG. 22), and inward in the down position (FIG. 23). The drawbar 340 has a tab 370 which, when the blocking member 364 is thrust outward (FIG. 22), contacts the abutment portion 364 such that the trigger 348 cannot be drawn backward to fire the firearm. This is also illustrated in FIG. 20. When the lock relay arm 346 is moved downward (FIG. 23), the blocking member 364 is not contacted by the shoulder 350 and can move inward toward the magazine 318. The tab 370 will then be permitted to pass the blocking member 364, such that the trigger 348 can be drawn and the firearm operated. This is shown in FIG. 21. A blocking ledge 373 can be provided on the abutment portion 364, and extends outwardly from the magazine 318. The blocking ledge 373, when the abutment portion 364 is positioned in the locked position (FIGS. 20 and 22), will contact the drawbar 340 such that the magazine 318 cannot be removed from the firearm. When the lock is in the unlocked position (FIGS. 21 and 23), the blocking ledge 373 is moved inward toward the magazine 318 such that the abutment portion 364 can pass the draw bar 340 and the magazine 318 can be removed from the firearm.

The manner by which the lock relay arm 346 operates with the lock 317, and the precise construction of the lock 317, is capable of variation. A preferred combination lock has corresponding key and key-way portions. One of the key and key-way portions is moveable relative to the other, such that the keys can enter the key-ways, and the lock relay arm is operatively connected to the moveable portion. One of the keys or key-ways are provided on a carrier, which is moved by a combination button to align the keys with the key-ways. The keys can then move into the key-ways to unlock the lock. Alternative arrangements are possible. The keys can be moveable into the key-ways, or the key-ways can be moveable over the keys. Also, the keys can be provided on carriers which are aligned with the key-ways, or the key-ways can be provided on carriers and moved to align with keys that remain fixed in position. The keys can be posts and the key-ways can be corresponding openings, although alternative cooperating structures such as tongues and grooves are also possible.

Preferred embodiments are shown in FIGS. 20–36. The lock relay arm 346 preferably has a lip 380 which engages a slot 386 in a slotted portion 390 of a slide assembly 400. The slide assembly 400 also includes a spring seat 410, downwardly extending support arms 414 and terminates in the manual lever 330. A ratchet member 420 is shown schematically in FIGS. 20 and 21, absent the other components of the lock 317 which are shown in other figures. Each ratchet member is a carrier which has a combination post 424 or key which must be aligned with an appropriate combination opening 428 or key-way in order to permit the slide assembly 400, and thus lock relay arm 346, to move downward (FIG. 21) to permit the abutment portion 364 to move inward and the tab 370 to move past the abutment portion 364 and permit operation of the firearm.

Figure 24:
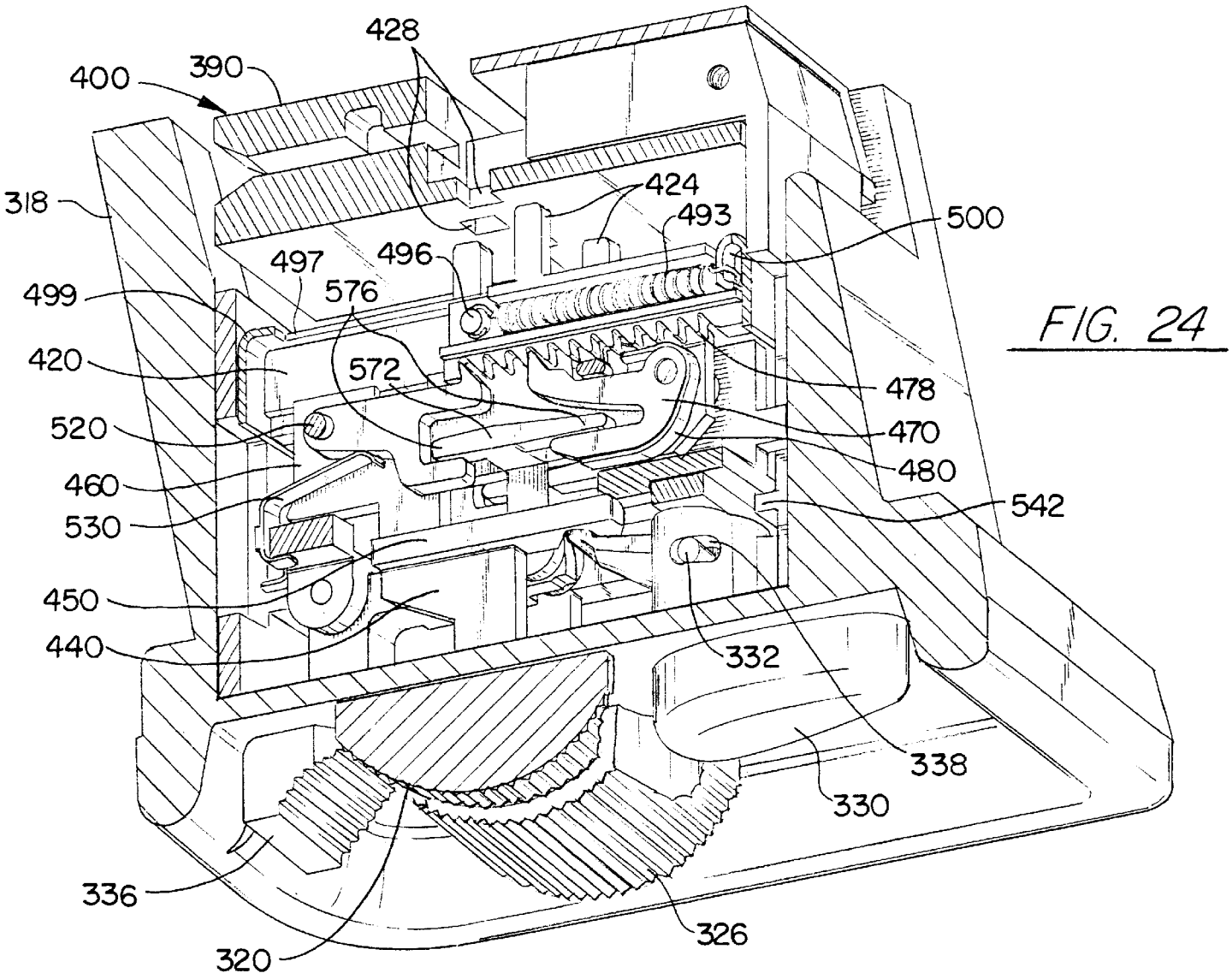
FIG. 24 is a perspective view of a magazine lock according to the invention, partially in cross section.
Figure 25:
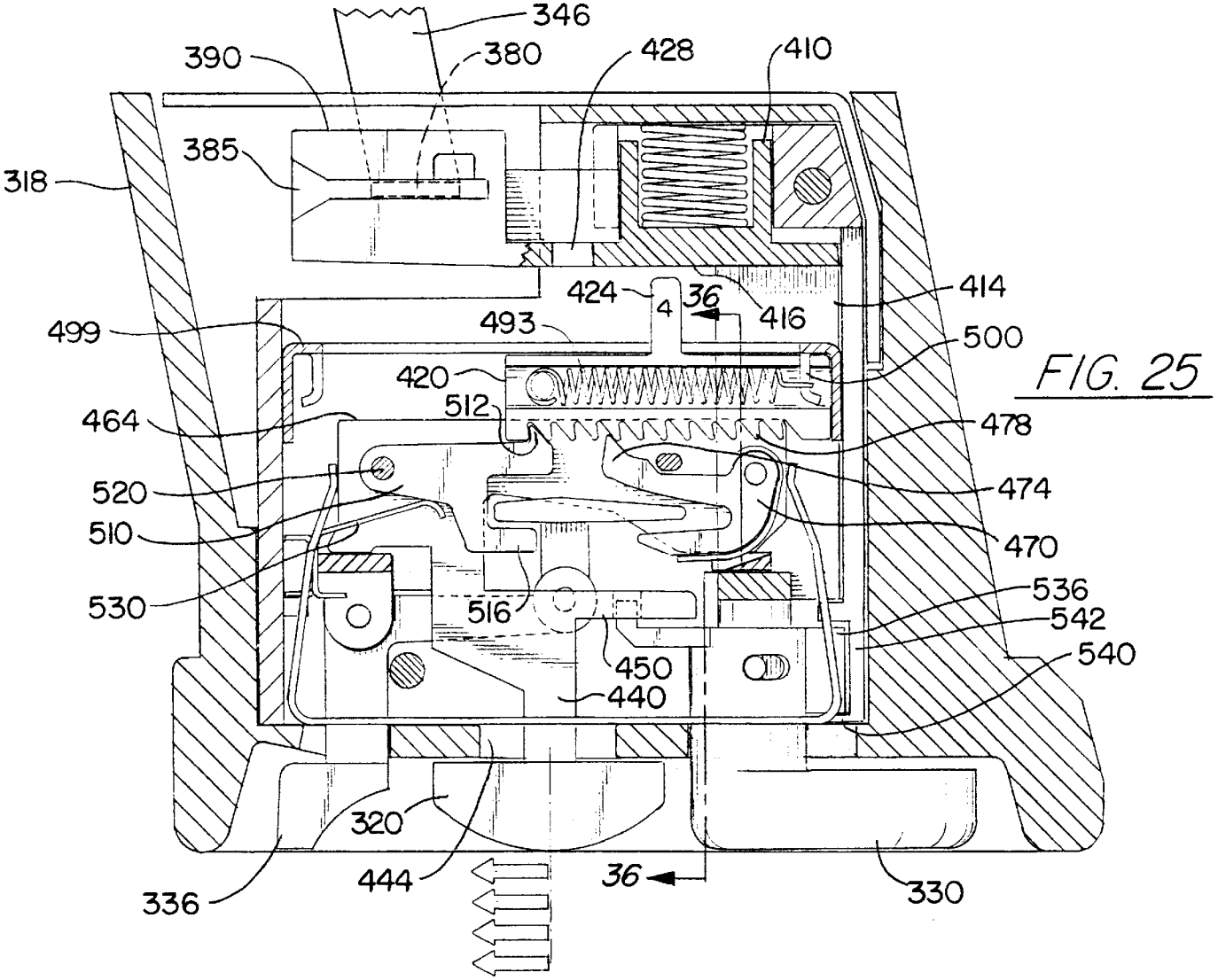
FIG. 25 is a side elevation, partially in cross section and partially in phantom, of a magazine lock according to the invention in a first mode of operation.
Figure 31:
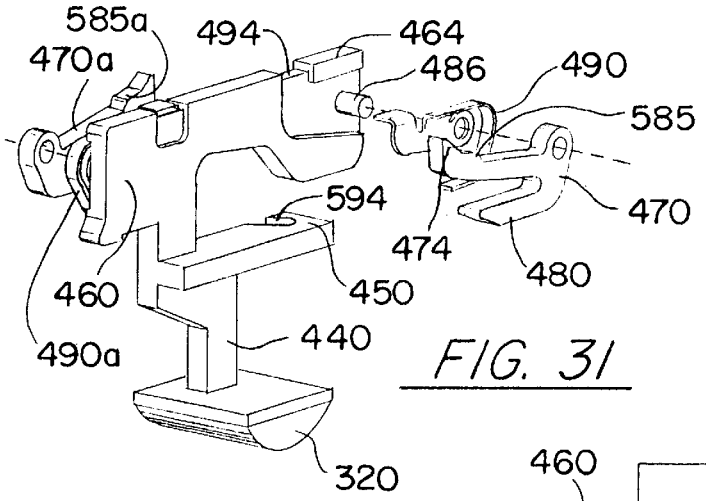
FIG. 31 is an exploded perspective view of a left combination button assembly.

The slide assembly 400 rests within the base of the magazine 318 as shown in FIGS. 24 and 25. The combination button 320 is part of a combination button assembly 322 which includes a shaft 440 that extends upwardly through a suitable opening 444 in the base of the magazine 318. An interlocking extension 450 extends from the shaft 440 of each button assembly (see FIGS. 31 and 32). Each button assembly terminates in a ratchet seat portion 460 having an upper surface 464. An indexing pawl 470 having an engagement tooth 474 and an actuating arm 480 is secured to a pin 486 on the ratchet seat portion 460. A spring 490 surrounds the indexing pawl 470 is also mounted to the pin 486 (FIG. 31). A lip 492 of the spring 490 rests on a ledge 494 of the ratchet seat portion 460.

Figure 36:
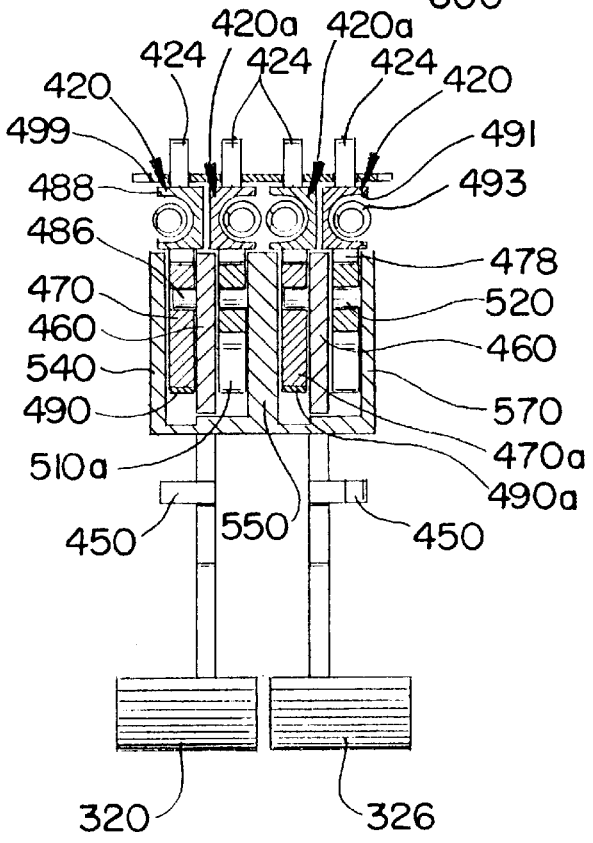
FIG. 36 is a cross section taken along on 36—36 in FIG. 25.

Each ratchet member 420 has a body 488 (FIG. 36). Ratchet teeth 478 depend downwardly from the body 488. The body 488 has a groove 491 in which the spring 493 is positioned. The combination posts 424 extend upwardly from the body 488, through grooves 497 in a guide plate 499.

The ratchet member 420 rests on the upper surface 464 of the ratchet support portion 460. A portion of the body 488 rests atop the upper surface 464 of the ratchet seat portion 460. The spring 493 engages a pin 496 on each ratchet member 420 (FIG. 24). The opposite end of the spring 493 is secured on a pin 500.

Figure 35:
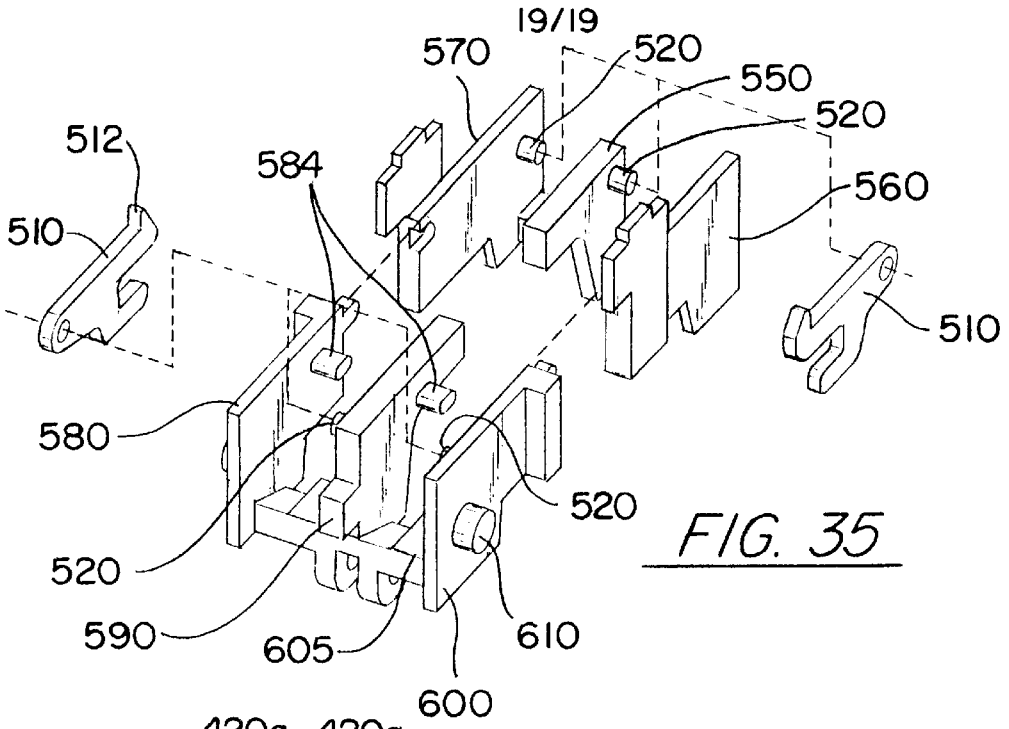
FIG. 35 is an exploded perspective view of a support plate assembly according to the invention.

The engagement tooth 474 of the indexing pawl 470 is urged upward into engagement with the teeth 478 of each ratchet member 420 by the action of the spring 490. Upon movement of the combination button 320 in the forward direction (FIGS. 25–26), the engagement tooth 474 will engage the teeth 478 of the ratchet member 420 and cause the ratchet member 420 to move a given distance equal to the throw of the combination button 320. A retaining pawl 510 has a tooth 512 that is used to engage the ratchet member 420 to prevent movement of the ratchet member 420 under the bias of the spring 493. An actuating arm 516 is provided for a reset function. The retaining pawl 510 is mounted by a suitable structure such as a pin 520 that is provided on suitable structure such as a support plate assembly (FIG. 35). Each of the support plate assemblies provide a guide for the combination button assemblies 322 and a surface on which to mount the retaining pawls 510. A first support plate assembly includes plates 560, 550 and 570. A second support assembly includes plates 580, 590, and 600. The plates can be joined by a connecting member 605. A middle support plate 550 includes the pin 520 to support the retaining pawl 510 of the left button 320. A second support plate 570 includes a pin 520 for supporting the retaining pawl 510 of the right button assembly 326. The support plate 580 includes an indexing pawl deflector 584. A middle support plate 590 includes a retaining pawl pin 520 and an indexing pawl deflector 584. The outer support plate 600 includes a locating post 610 and a pin 520 for mounting a retaining pawl 510. A retaining spring 530 acts to urge the tooth 512 of the retaining pawl 510 into engagement with the teeth 478 of the ratchet member 420.

Figure 26:
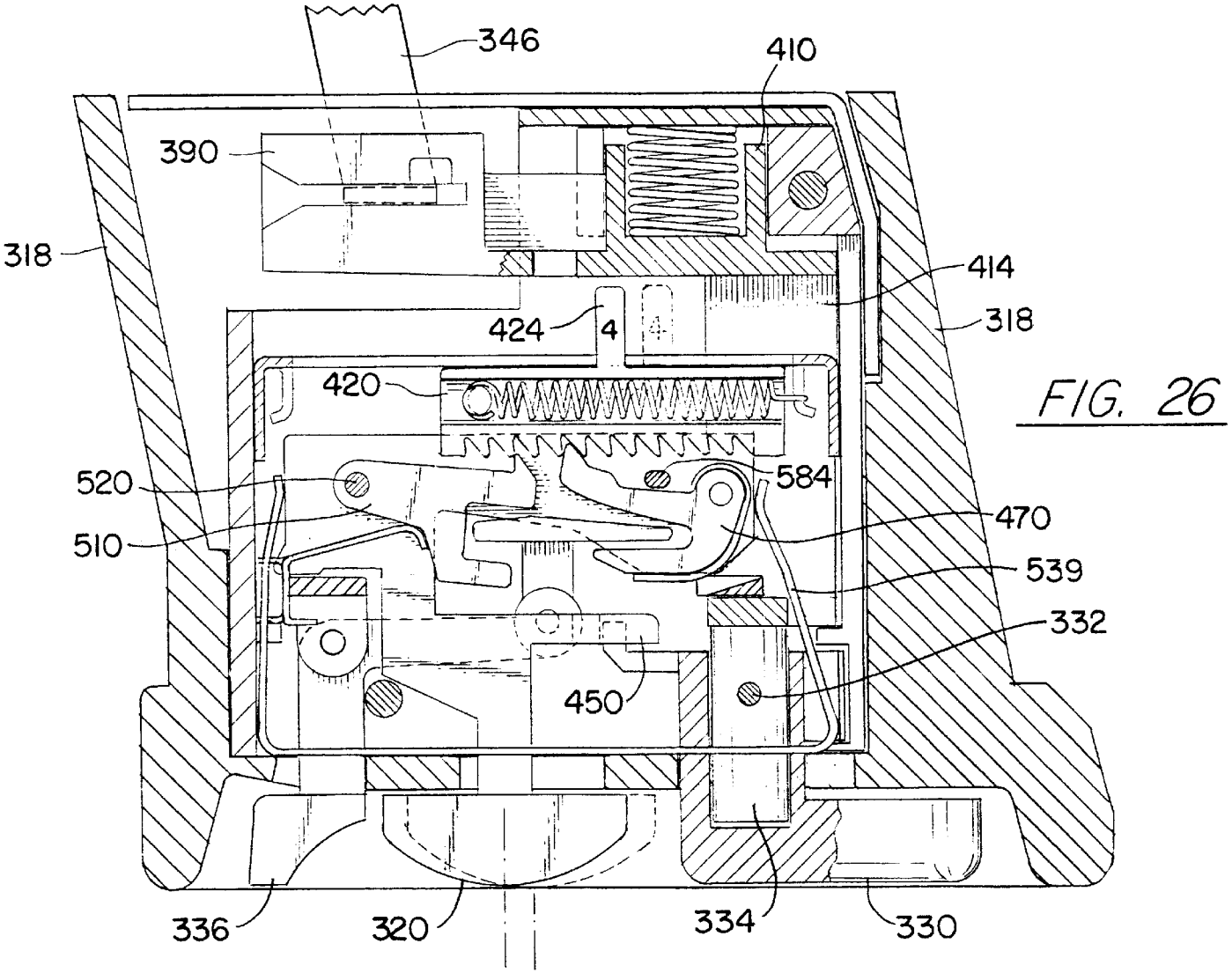
FIG. 26 is a side elevation, partially in cross section and partially in phantom, of a magazine lock in a second mode of activation.

The manual lever 330 includes a tab 536 which rests on a seat 540 of the housing. This prevents the manual lever 330 from moving downward through an opening 544 of a housing 542. A spring 408 rests in the spring housing 410 and acts against a surface 416 of the slide assembly 400. The spring 408 acts to drive the slide assembly 400. The manual lever 330 is attached by a pin 332 to a post 334 (FIG. 26). This permits the manual lever 330 to pivot relative to the post 334 about a slot 338 (FIG. 24). Upon rotation of the manual lever 330, the tab 536 rotates to the opening 544 which permits the manual lever 330, post 334, support arms 414 and slotted portion 390 of the slide assembly 400 to move downward under the biasing action of the spring 408.

Figure 27:
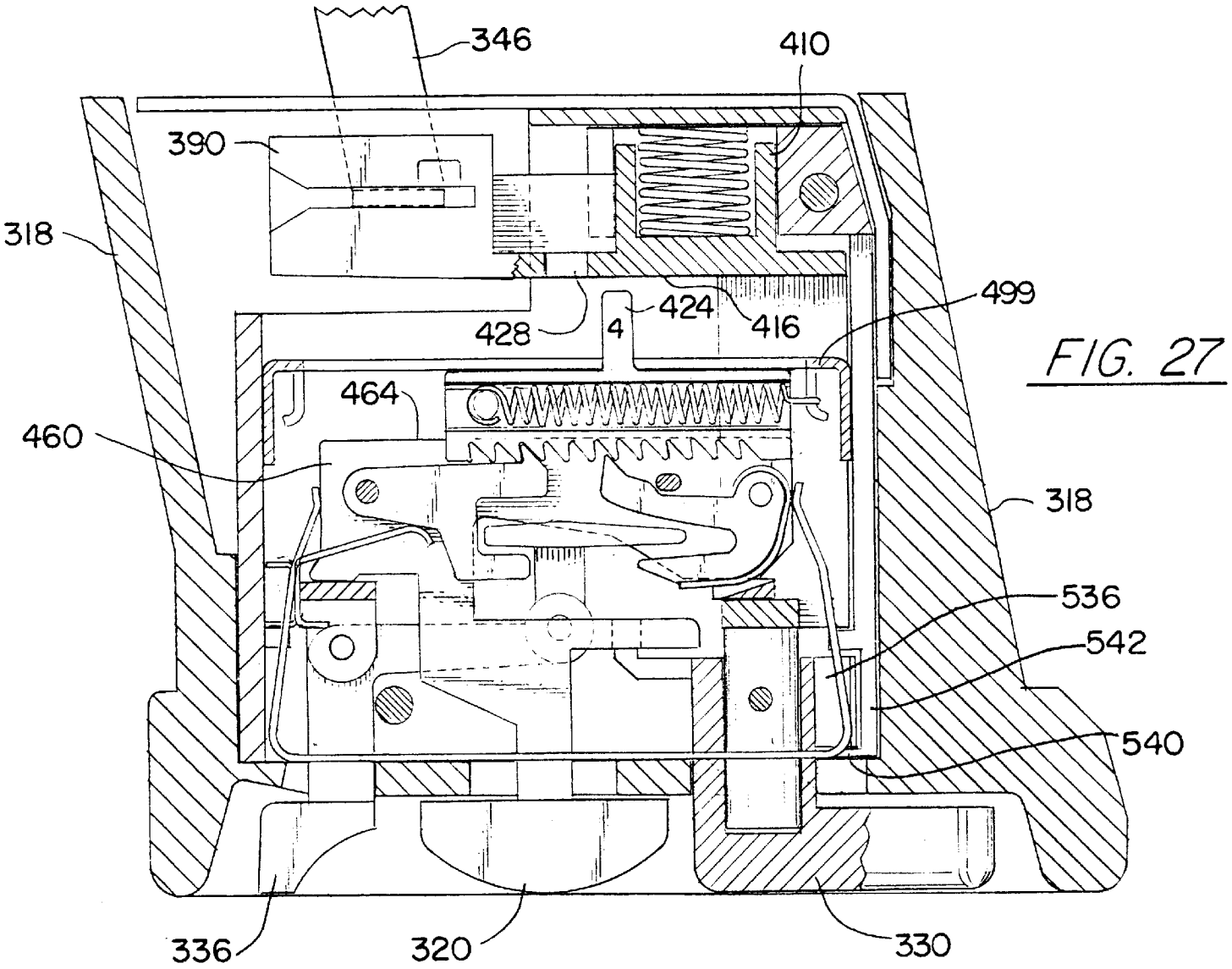
FIG. 27 is a side elevation, partially in cross section and partially in phantom, in a third mode of operation.

Operation of the lock is seen with reference to FIG. 25. The left combination button 320 is shown in the centered position relative to the opening 444. Upon movement of the combination button 320 to the left, the indexing pawl 470 engages the teeth 478 of the ratchet member 420 and carries the ratchet member 420 forward a distance equal to the throw length of the combination button 320 (FIG. 26). The retaining pawl 510 moves over the ramp surface of the teeth 478 so as to engage a succeeding tooth and retain the position of the ratchet member 420 (FIG. 26). The centering spring 539 will then act to return the combination button assembly to the original, centered position. The tooth 474 of the indexing pawl 470 will pass over the ramped surface of the teeth 478 of the ratchet member 420 during the return motion of the button assembly. As the retaining pawl 510 is fixed to one of the supports plates (FIGS. 35 and 36) and is not fixed to the combination button assembly, the retaining pawl 510 will retain the ratchet member 420 in position upon the return of the combination button assembly to the original, centered position (FIG. 27).

Figure 28:
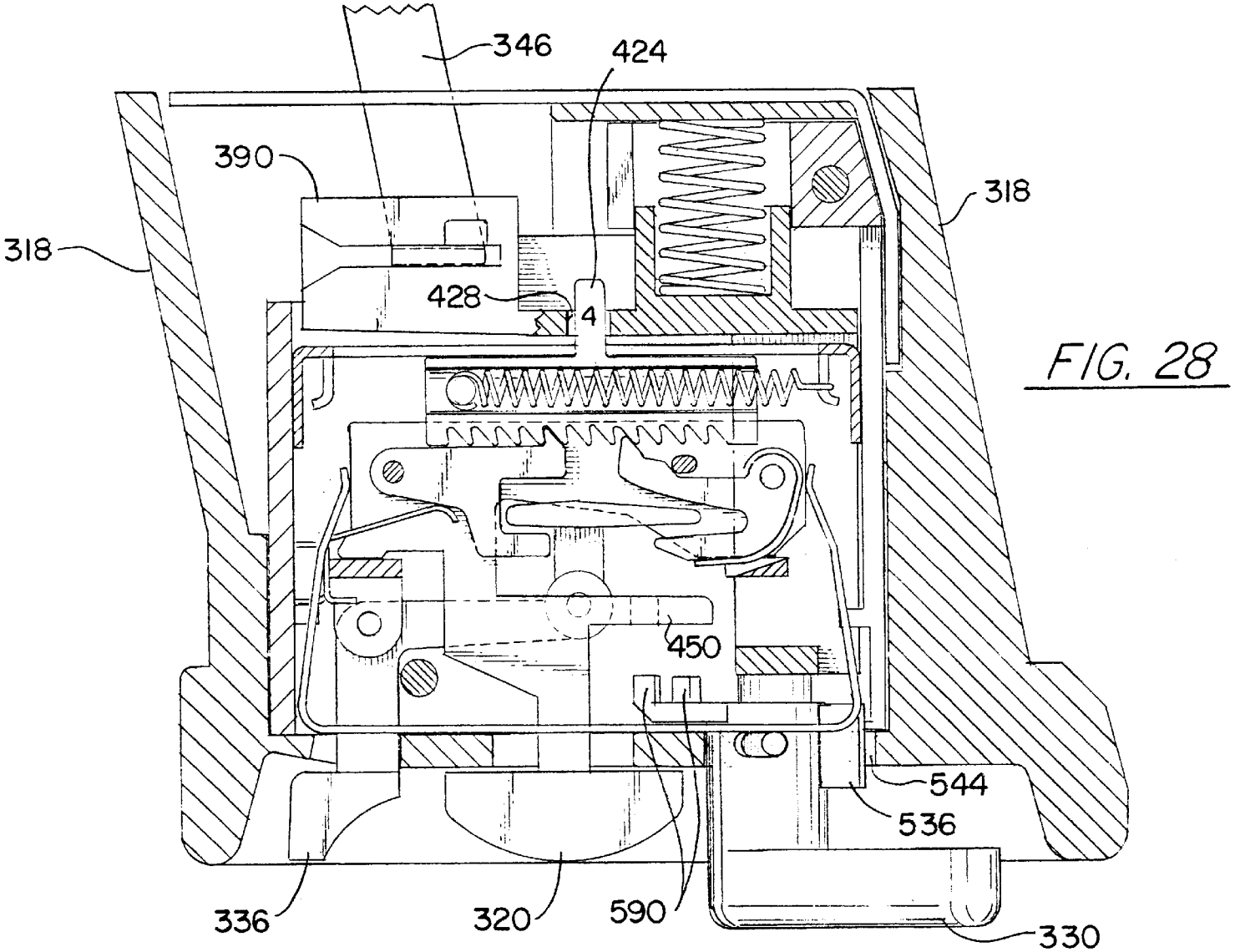
FIG. 28 is a side elevation, partially in cross section and partially in phantom, in an unlocked configuration.
Figure 29:
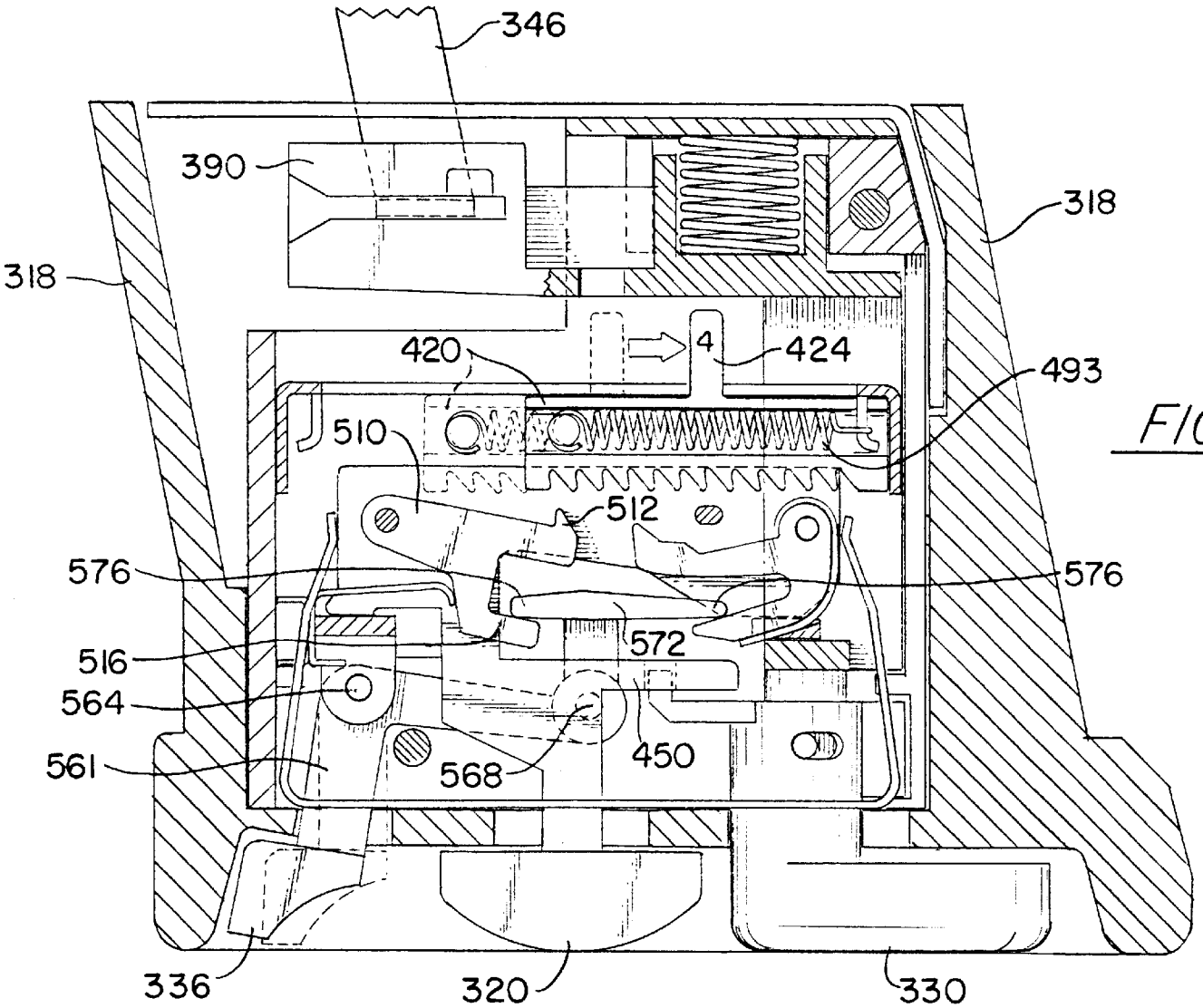
FIG. 29 is a side elevation, partially in cross section and partially in phantom, in a reset configuration.

The ratcheting action of the buttons continues until the combination posts 424 are aligned with the combination openings 428 (FIG. 28). Upon this occurrence, it is possible to lower the slide assembly 400 under the biasing action of the spring 408 (FIG. 28). The posts 424 are now aligned with the respective combination openings 428 and will pass through the respective opening so as to permit lowering of the slide assembly 400. The manual lever 330, however, will not permit the lowering of the slide assembly because the tab 536 remains in contact with its seat 540 in the housing 542 (FIG. 27). It is necessary to rotate the manual lever 330 in the manner shown in FIGS. 33–34 in order to lower the slide assembly 400 in the manner shown in FIG. 28.

Rotation of the manual lever 330 will cause the tab 536 to move off of the seat 540 and to permit the manual lever 330 to lower in the manner depicted in FIG. 28. Lowering of the slide assembly 400 results in lowering of the slotted portion 390. This in turn will lower the relay arm 346 which will enable the operation of the firearm or removal of the magazine, as previously described.

Setting the lock to the locked position requires that the slide assembly 400 be returned to the upright position shown in FIG. 25. The manual lever 330 is pushed upward against the biasing of the spring 408, which raises the slide assembly 400 and the lock relay arm 346. The manual lever 330 is then rotated to the original position where the tab 536 rests on the seat 540 of the housing 542 to retain the assembly and the relay arm 346 in the locked position. It is now necessary to reset the ratchet members 420 to an initial position whereby the combination posts 424 are no longer in alignment with the combination opening 428 and the lock is again in the "locked" position.

The reset function is accomplished with the reset button 336. This button function is in the manner shown in FIG. 29. The reset button 336 includes an L-shaped actuating arm 561 which is pivotally mounted on a pin 564. A second pivot point 568 connects to a reset head 572 which has a plurality of arms 576 (FIG. 24). The reset arms 576 are adapted to contact each of the actuating arms 480 on the indexing pawl and the actuating arms 516 on the retaining pawl. Movement of the reset button 336 causes downward movement of the reset arms 576 to contact the actuating arms 480 of the indexing pawls 470 and actuating arms 516 of the retaining pawls 510. Each of the pawls will be drawn downward in the manner depicted in FIG. 29, out of engagement with the ratchet teeth 478. This will permit each ratchet member 420 to move under the bias of the springs 493 to an original position. Upon release of the reset button 336, the indexing pawl 470 and retaining pawls 510 will return to the original position, in engagement with the teeth 478 of the ratchet members 420.

Figure 33:
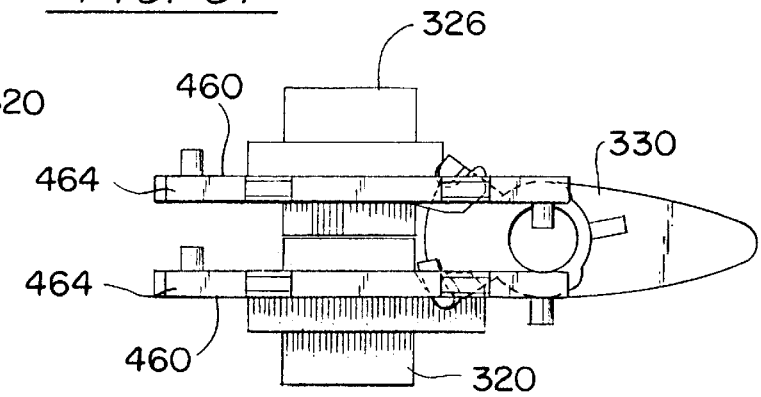
FIG. 33 is a top plan view, partially in phantom, of a manual lever, as used with the combination buttons, and in a first mode of operation.
Figure 34:
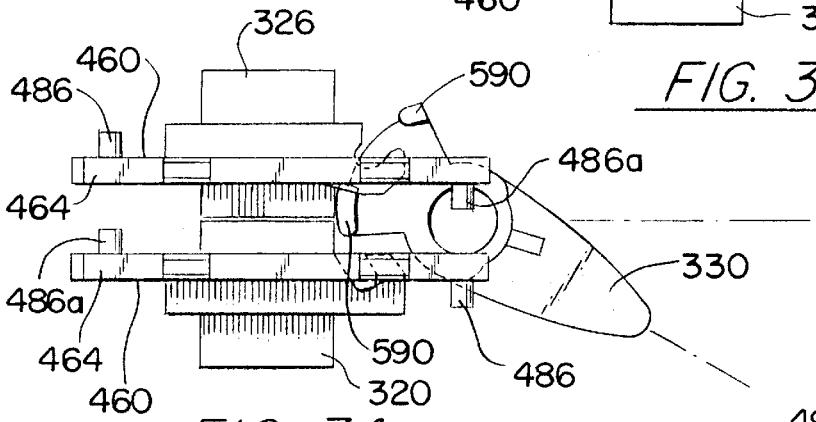
FIG. 34 is a top plan view of the manual lever, in a second mode of operation.
Figure 32:
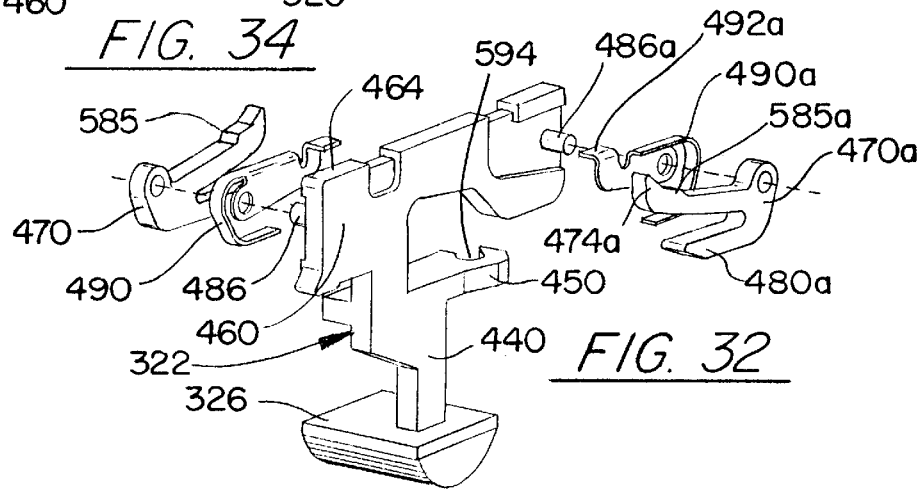
FIG. 32 is a perspective view of a right combination button assembly.

The slide assembly 400 will lower when the manual lever 330 is in the position shown in FIG. 33, when the tab 536 is aligned with the opening 544. This is depicted in FIG. 28. In the event that the combination posts 424 have not been properly aligned with the combination openings 428, however, the slide assembly 400 will not lower properly, but instead will lower to the point of contact between the surface 416 and the combination posts 424. It is desirable that the combination buttons are not operated at this point, as the contact between the combination posts 424 and the slide assembly 400 could result in improper operation. Accordingly, interlocking posts 591 are provided to engage interlocking slots 594 in the combination button assemblies 320 and 326 (FIGS. 31–34) . The interlocking posts 591 are engaged to the interlocking slots 594 when the tab 536 is positioned over the opening 544, that is, when the manual lever 330 is capable of moving downward. Therefore, in the event that the combination posts 424 have not been properly aligned with the combination openings 428, the combination buttons 320 and 326 cannot be operated (FIG. 33). The manual lever 330 must be rotated to the position shown in FIG. 34, where the tab 536 is positioned away from the opening, in order to operate the combination buttons. The manual lever 330 must be pushed completely upward into the lock housing, in the position shown in FIG. 25, in order for this to occur. This will raise the slide assembly 400 to a position where the surface 416 is no longer in contact with the combination posts 424. The combination buttons 320 and 326 can then be operated until the correct combination has been entered, at which time the manual lever 330 can be rotated to the position shown in FIG. 33 and lowered to the position shown in FIG. 28.

Figure 30:
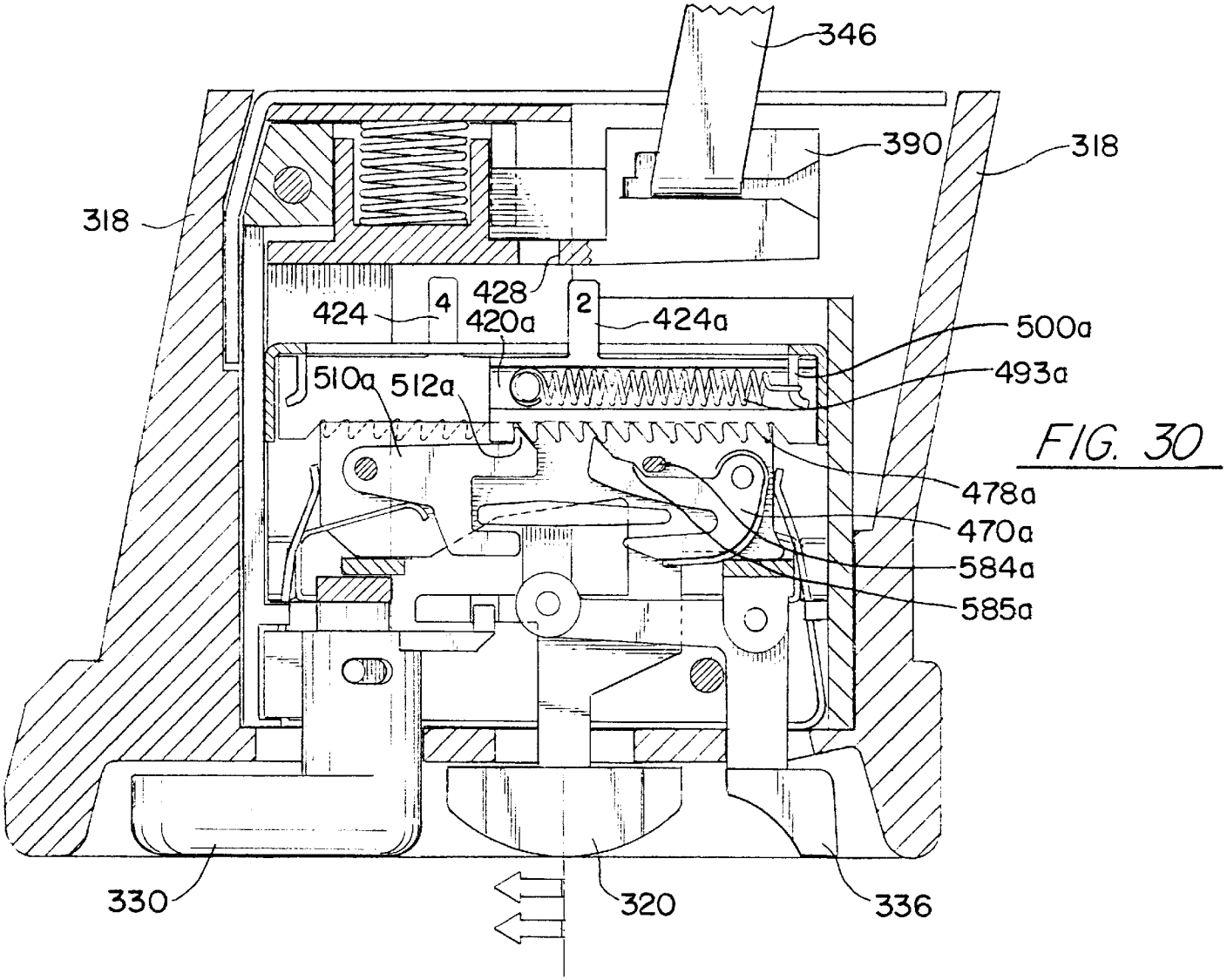
FIG. 30 is a side elevation of an opposite side of the combination button assembly to that shown in FIG. 25, illustrating a second ratchet member that is operable by the same combination button.

The invention is also capable of construction in a manner which will permit two ratchet members to be operated by a single combination button. This is illustrated in FIGS. 30 and 36, where the reverse side of the left combination button assembly 320 is shown. A second ratchet member **420*a* having a combination post 424*a* and ratchet teeth 478*a* is provided. Similarly, a spring 493*a* is connected between a pin 500*a* on the guide plate 499 and a pin 496*a* on the ratchet member 420*a*. An indexing pawl 470*a* is provided on an opposite side of the button assembly 320. As shown in FIGS. 35 and 36, the ratchet members 420 and 420*a* rest in part on the ratchet seat portion 460 of the combination buttons, and also on upper surfaces of the plates, as shown in FIG. 35. The ratchet seat portion 460 of each combination button assembly is positioned between the center plates 550 and 590 and the outside plates 570, 580 or 560, 600. The ratchet members 424 rest partially on the top surface 464**, and partially on the top surface of the upright plates.

Movement of the ratchet member 420 in the forward direction, as illustrated in FIGS. 25–27, could also affect the ratchet member **420*a* since the indexing pawl 470*a* is also carried on the ratchet seat portion 460 of the button assembly 320. As shown in FIG. 30, this is prevented by the indexing pawl deflector 584*a*. This surface contacts a surface 585*a* on the indexing pawl 470*a* when the button is moved in the forward direction (towards the trigger) to lower the indexing pawl 470*a* out of contact with the teeth 478*a*. The retaining pawl 510*a* will slide over the teeth 478*a*** in this direction of movement.

Operation of the combination button 320 in the reverse direction, as indicated by the arrows in FIG. 30, away from the trigger, will have an opposite effect. The indexing pawl **470*a* will engage the teeth 478*a* and the ratchet member 420*a* will move in the manner previously described. The retaining pawl 510*a* will maintain the ratchet member 420*a* in the proper position. On the opposite side of the button assembly 320, the index pawl deflector 584 will contact the surface 585 on the indexing pawl 470 to lower this indexing pawl 470 out of contact with the teeth 478 of the ratchet member 420. The combination post 424 indicated by "4" on the ratchet member 420 therefore will not move when the button 320 is moved in the reverse direction, away from the trigger, as indicated by the arrows in FIG. 30. In this manner, it will be appreciated that forward movement of the button 320 toward the trigger, will move the ratchet member 420 and the combination post "4", but will not move the ratchet member 420*a* and the combination post "2". Rearward motion of the combination button 320 will correspondingly cause movement of the ratchet member 420***a* and the combination post "2", while the ratchet member 420 and combination post "4" will remain fixed in position.

It will be understood that the invention is capable of taking alternative forms. With minor modification, the lock relay arm 346 can be fashioned to extend over the opening of the magazine, where the bullets 314 enter, when the lock is in the locked position. In this embodiment, when the lock is locked, the bullets 314 cannot be removed from the firearm, and the bullets therefore cannot be fired. Also, it will be appreciated that the lock 317 could be used for other purposes besides a lock for firearms, by modifying the lock relay arm 346 into a bolt or other component typical of locks.

It is to be understood that while there are illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

I claim:

1. A lock comprising:

a plurality of lock members moveably mounted relative to a lock frame, each lock member being independently moveable relative to other lock members and in first and second, substantially opposite directions;

means for returning the lock member to an initial position after movement in either of said directions;

first and second carriers associated with each lock member, said first carrier being moved when said lock member is moved in said first direction, and said second carrier being moved when said lock member is moved in said second direction;

means for retaining said carriers in place after movement by said lock member, and after said lock member returns to said initial position;

corresponding key and key-way portions associated with each carrier and the frame such that movement of the lock members a preselected number of times in said first and second directions is necessary to align the key and key-way portions, said key and key-way portions being moveable relative to each other such that the keys, when properly aligned with the key-ways, can move through said key-ways; and, a lock portion associated with one of the keys and key-way portions, such that movement of the keys into the key-ways will cause movement of the lock portion into an unlocked position.

2. The lock of claim 1, wherein said lock member is a combination button assembly and said carriers are ratchet members, a first indexing pawl being fixed to said combination button assembly for moving said first carrier when said combination button assembly is moved in said first direction, and a second indexing pawl being fixed to said combination button assembly for moving said second ratchet member when said combination button assembly is moved in said second direction.

3. The lock of claim 2, wherein said means for retaining said ratchet members in position following movement by said combination button assembly are retaining pawls that are fixed to a support and relative to said frame.

4. The lock of claim 2, wherein said keys are posts attached to said ratchet members, and said key-ways are openings in a slide assembly, alignment of the posts with the openings permitting the slide assembly to move toward the ratchet members, said lock portion being connected to the slide assembly and thereby moving to an unlocked position.

5. The lock of claim 1, further comprising engagement structure operatively connected to one of the keys or key-ways such that, in a first position, said engagement structure prevents relative movement between the keys and key-ways, and in a second position, said engagement structure permits relative movement between said keys and key-ways.

6. The lock of claim 5, wherein said engagement structure is a lever which, in said first position, engages a shoulder so as to prevent relative movement between said key and key-ways, and in said second position is not engaged to said shoulder so as to permit relative movement between said keys and key-ways.

7. The lock of claim 5, wherein said engagement structure, in said second position, engages said lock members so as to prevent operation of said lock members.

8. The lock of claim 1, further comprising reset means for returning said carriers to an initial position.

9. The lock of claim 3, further comprising a reset member for returning said ratchet members to an initial position, said reset member being operable to move said indexing pawls and said retaining pawls out of engagement with said ratchet members.

* * * * *